US006250742B1

(12) United States Patent
Kido

(10) Patent No.: US 6,250,742 B1
(45) Date of Patent: Jun. 26, 2001

(54) IMAGE FORMING APPARATUS FOR REDUCING INK PARTICLES USING LIQUID AGENT OR HEAT

(75) Inventor: Mamoru Kido, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/184,046

(22) Filed: Nov. 2, 1998

(30) Foreign Application Priority Data

Nov. 11, 1997 (JP) ..... 9-308677

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158, 95, 96; 399/5 S, 292, 293, 294, 295

(56) References Cited

U.S. PATENT DOCUMENTS 5,977,421 * 11/1999 Hanson et al. .
6,126,274 * 10/2000 Kohyama ..... 347/55

FOREIGN PATENT DOCUMENTS 3-240072 10/1991 (JP) .

OTHER PUBLICATIONS

"Numerical Analysis on Potential Distribution in the Development Zone of a Copying Machine and its effect on the Contrast Potential", Hiroshi IMADA et al., Apr. 12, 1993, pp. 253–259.
"Toner Jet Color Printing", Jerome Johnson, pp. 267–269.
"Technology Assessment of Oce 3125C Copier", Robert Gruber, 1996.

* cited by examiner

*Primary Examiner*—John Barlow
*Assistant Examiner*—Raquel Yvette Gordon
(74) *Attorney, Agent, or Firm*—Oliff & Berridge, PLC

(57) ABSTRACT

An image forming apparatus is provided which is applied to copying machines, facsimile apparatuses, printers and the like, in which individual positions of particles for forming an image are properly controlled to form a high-quality image. Particles for forming an image are caused to move onto pixels, which individually respond to image signals, to reduce the diameters of the particles moved.

11 Claims, 24 Drawing Sheets

IMAGE FORMING APPARATUS FOR REDUCING INK PARTICLES USING LIQUID AGENT OR HEAT

BACKGROUND OF THE INVENTION

1. Field of the Invention

The present invention relates to an image forming apparatus applied to copying machines, facsimile apparatuses, printers and the like.

2. Prior Art

Conventionally, there has been known an image forming apparatus of the electrophotographic type for forming an electrostatic latent image on a photoreceptor, obtaining a toner image by developing with toner, and transferring the toner image on a sheet directly or through an intermediate transfer medium for fixing. The toner used for this electrophotographic type is solid particle-shaped toner prepared by adhering pigment into a styrene acryl or polyester binder with a diameter of about 7 to 10 $\mu$M. as processes relating to toner movement, there are two known processes: developing and transfer processes, and variations in the positions of a group of toner particles such as toner scattering, pre-transfer and toner explosion pose a serious problem as image defects in both processes. By reducing a gap between the photoreceptor and the development sleeve as far as possible, actually bringing the developing electrode closer by using conductive toner to reduce toner scattering, controlling the posture of a sheet entering a transfer nip, removing the electric charge carried by a visible image formed on the photoreceptor, or de-electrifying the toner image transferred onto a recording medium, the above-described problem can be considerably reduced.

When, however, the toner particle diameter is further rendered minute to improve the image quality, the electric field condition in which the toner is handled is completely changed. When the toner particle diameter is reduced to half from 10 $\mu$m to 5 $\mu$m, the amount of charge is reduced to ¼ if the toner charging condition is constant because the amount of charge which simple toner is capable of charging is in proportion to its surface area. Namely, the force F to which the toner is subjected from an electrostatic field E is reduced to ¼ as shown below, and the effective driving force exerting on the particle reduces with the square of the reduction rate of the diameter $$F=q'\cdot E, S=4\pi r^2$$

where S: Surface area of particle, r: Particle radius, q: Amount of charge on toner, and q': Amount of charge on toner (particle diameter½), $$q'=f(S)\rightarrow q'=\tfrac{1}{4}\times q\cdot E \quad \therefore F=q'\cdot E=\tfrac{1}{4}\times q$$

On the other hand, as an adhesive force between a particle and a member for supporting and arranging the particle, a van der Waals force Fv is always acting in addition to an electrostatic force, and this van der Waals force Fv is in proportion to the radius r as represented by the following equation:

$$Fv=\{hw/(8\pi r^2)\}\text{i} \times \text{r}$$

where hw: Lifshitz-van der Waals force constant, z: object-to-object distance, r: particle radius. This means that when the toner particle diameter is rendered minute to improve the image quality, the van der Waals force required for rendering the diameter minute can be reduced by an amount corresponding to the ratio in diameter, but the amount of charge which can be charged for the square of the reduction ratio in diameter is reduced conversely. Therefore, the adhesive force Fv due to the van der Waals force becomes predominant even if an electric field greater than the maximum electric field (spark discharge starting electric field) based on the Paschen Rule may be imparted, and the electric-field tolerance in which transfer can be performed while toner is being sufficiently controlled will become exceedingly narrow. Also, in the case of only one layer of the toner particles, the van der Waals force Fv becomes extraordinarily greater than an adhesive force acting between the toner particles in the case of a multi-layer toner having a plurality of toner particles stacked. Therefore, relationship between the van der Waals force Fv and driving forces for movement, flying, transfer and adhesion which are capable of effectively acting on the particles becomes important, and in the conventional electrophotographic type, it is difficult to move the toner by imparting an electrostatic field within a range not exceeding the Paschen Rule to the one-layer toner.

In the developing and transfer processes using conventional multi-layer toner, the toner scattering occurs as described above. Since the adhesive force between the toner particles is weak, spatial extent of the electric field or the magnetic field causes transfer onto undesirable pixel positions conversely, or drop or scattering occurs because of multi-layer even if adhered to desirable pixel positions. Also, in order to secure developing density or transfer density higher than a certain level, an excessive electric field or magnetic field is imparted, and there may be also seen a phenomenon in which toner particles bounce and are scattered around even if they are shot onto desired pixel positions. For example, FIG. 1 shows a principle diagram for Toner Jet Type of Array Printers AB Inc., and a tandem type color image sample was presented for the first time in the NIP12 IS&T 1996, which has image quality of very conspicuous toner scattering. This type adopts the directly-recording technique using no photoreceptor, and there are provided mesh electrodes 5 between a development sleeve 1 and a sheet 3, and a back plate 2 on the back of the sheet, a voltage 8 of 1500 V is applied between the development sleeve 1 and the back plate 2, and an electric field based on control voltage 7 of 275 V is imparted to the mesh electrode 5 when an image is formed (toner passes through the mesh holes) and an electric field based on control voltage 7 of −50 V is imparted when no image is formed (toner does not pass through the mesh holes) to form an image. This type is an image forming method for controlling the toner as a mass under the electric field imparted and not controlling the simple toner individually. Therefore, the technical problems are toner clogging into the mesh electrode holes, adhesion or contamination to the mesh electrodes themselves, and toner scattering 10 caused by bounce of the toner shot onto the sheet 3 as shown in FIG. 2, resulting in problems such as necessity of cleaning and worsened graininess. Also, when there are variations in speed of the sheet 3 conveyed, no effects are exhibited to the variations in the speed by the control using the mesh electrode.

In Japanese Published Unexamined Patent Application No. Hei 3-240072, there is described the recording technique for forming an image at low potential gradient using such mesh electrode and a reference electrode for imparting a DC electric field. As problems associated with this type, the problems of clogging of the mesh electrode holes with toner and contamination by adhesion to the mesh electrode itself have been pointed out frequently, and in addition, the magnitude of the adhesive force on causing the toner to fly from the development sleeve has been pointed out. When the adhesive force based on the van der Waals force between the toner and the development sleeve is strong, the toner cannot fly at low electric potential, but it becomes necessary to impart considerably high voltage. Therefore, the risk factor of breaking down becomes higher in view of waste energy, environment and change with time.

Oce' 3125C Euro Color Copier is 400 dpi ring electrodes arranged in the axial direction of the imaging drum, and voltage based on the image information is imparted to driving electrodes provided within the imaging drum to develop the toner from a magnet roll. In this type, conductive magnetic mono-component toner is used, and an image formed on the imaging drum is of a single layer. Therefore, in the case of forming a full color image, it is necessary to rotate the imaging drum and the intermediate member drum with a considerably high degree of accuracy or to improve the rigidity of the constituent members in advance, leading to higher costs.

In the case of a type of recording by moving toner in this way, there is certainly a gap between the development sleeve and a sheet, and variations in the speed between them cause deviations in pixel positions, resulting in image defects such as color deviation and banding, or problems associated with reliability such as contamination and clogging caused by toner adhesion on the control electrodes. Further, the most serious problem of the prior art is poor peeling property between the development sleeve and the toner, and various countermeasures against this are considered.

Problems to Be Solved by the Invention

The present invention has been achieved in the light of the above-described state of affairs, and is aimed to provide an image forming apparatus capable of properly controlling individual positions of particles for image formation to thereby form a high quality image.

SUMMARY OF THE INVENTION

An image forming apparatus according to the present invention, which accomplishes the above-described object, is characterized by comprising:

- a particle conveying member for carrying a particle, whose diameter reduces when it is subjected to a predetermined stimulus, on the surface thereof, to convey it to a predetermined particle moving position;
- a particle moving part for moving the particle conveyed by the particle conveying member to a position in conformity with image information on a predetermined image carrier, which has moved to a position opposed to the surface of the particle conveying member in the particle moving position; and
- a particle diameter reducing part for reducing the diameter of the particle by imparting a predetermined stimulus to the particle moved onto the image carrier.

The above-described image carrier may be an image recording medium on which an image is finally recorded, or the image carrier may be an intermediate recording medium, on which an image is temporarily recorded, and may be provided with a transfer part for transferring an image recorded on the intermediate recording medium which consists of an assemblage of particles whose diameters have reduced, on an image recording medium, on which an image is finally recorded, directly from the intermediate recording medium, or through an intermediate transfer medium other than the intermediate recording medium.

The present invention includes these both aspects.

DETAILED DESCRIPTION OF PREFERRED EMBODIMENTS

Embodiments of the Invention

On describing the embodiments according to the present invention hereinafter, first the principle of the present invention will be described in detail, and thereafter concrete embodiments will be described.

Figure 1:
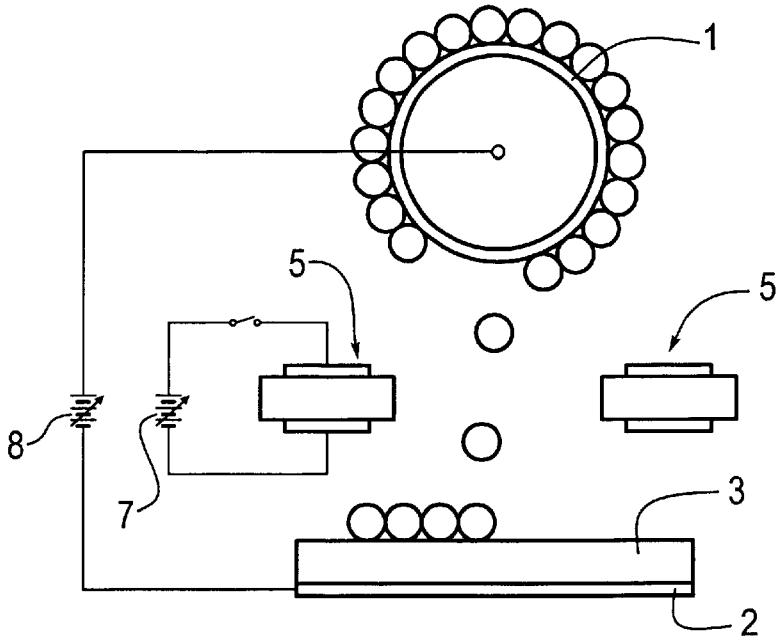
FIG. 1 structural view showing a toner jet type.
Figure 2:
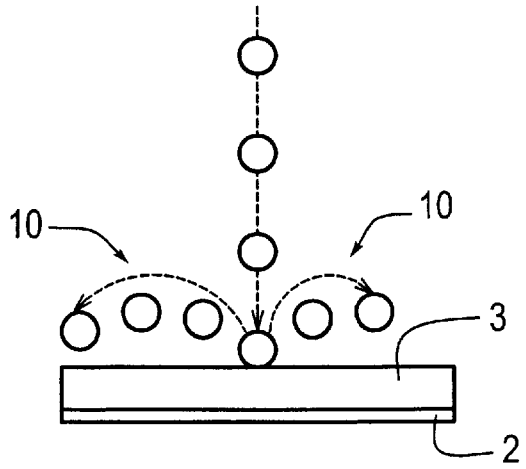
FIG. 2 is an explanatory view illustrating problems for the toner jet type shown in FIG. 1.
Figure 3:
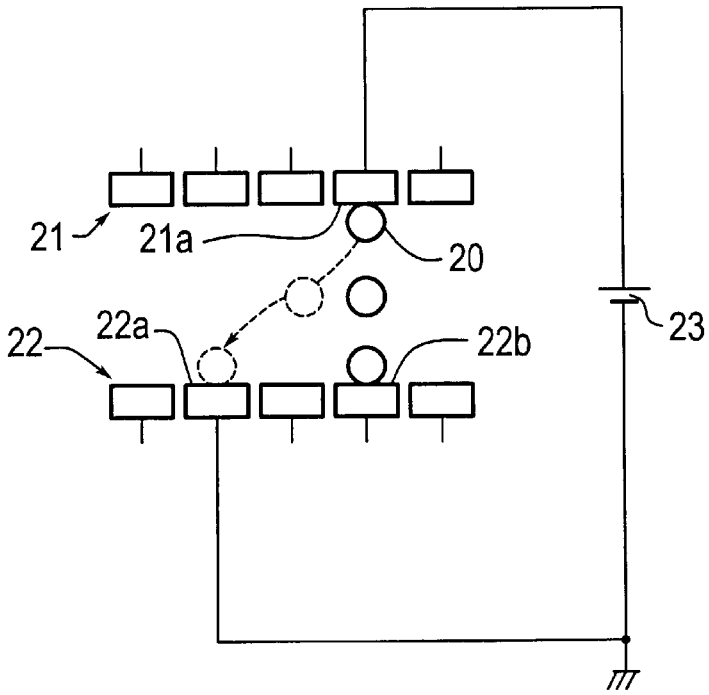
FIG. 3 is a structural view showing a particle moving part as a comparative example.

FIG. 3 shows a comparative example of a type of causing a particle to move, fly and transfer using an electric field. First, this comparative example and its problems will be described.

The particle 20 is assumed to be uniformly arranged on a particle conveying member 21 in advance. When this particle conveying member 21 has discrete electrode structure, a uniform thin layer for the particle 20 can be implemented by applying voltage to all the electrodes in the particle conveying member 21 between it and a supply part (not shown) for supplying the particle 20. Of a group of particles constituting the uniform thin layer thus formed, focusing attention on a certain particle 20, voltage is applied to an electrode 21*a* supporting the particle 20. On the other hand, an image carrier 22 also has discrete devise structure for each pixel, and when an attempt is made to cause the particle 20 to move to an object pixel 22*a* on the image carrier 22, the particle 20 moves to a pixel 22*b* on the image carrier 22, which is located at the shortest distance from the particle conveying member 21. This is caused by the extent of a spatial electric field formed between the particle conveying member 21 and the image carrier 22 by the applied voltage 23, or failure to correctly control the movement to the object pixel 22*a* because of excessively high initial electric field energy. If there is no relative misregistration between the particle conveying member 21 and the image carrier 22, and there is no misregistration of the electrode 21*a* and the electrode 22*a* in the process direction (advancing direction of the particle conveying member 21 and the image carrier 22), the particle 20 could be shot onto the electrode 22*a* on the image carrier 22, which is located at the shortest distance as viewed from the electrode 21*a*. However, the particle 20 is complicatedly affected by the extent of the spatial electric field or a spatial electric field caused by voltage (extent of electric field in the horizontal direction) developed on adjacent electrodes to be described later. Further, to eliminate the relative misregistration between the particle conveying member 21 and the image carrier 22 is to improve the mechanical precision in the so-called conventional image components, or to improve the control precision for them, and there is apprehension that the cost may be increased or the reliability may not be ensured.

Also, the adhesive force caused by the van der Waals force acting between the particle 20 and the particle conveying member 21 poses a serious problem. As a precondition in the present invention, it is considered that to form a uniform thin layer in the group of particles in advance is indispensable to obtain high image quality with good graininess when an image is formed on the basis of the next image input signal. It is very convenient to control one piece each of particles that the particle layer be, if possible, formed in a uniform (monodisperse distribution with uniform particle diameter) mono-layer state. As described above, however, the adhesive force becomes several nN to hundreds nN, and particularly, the adhesive force between the photoreceptor and the toner reaches 50 to 80 nN. Then, an electric field enough to correspond with the adhesive force must be imparted, and the initial energy imparted to the particle 20 becomes very high. Accordingly, in view of this point, the particle 20 will fly to the opposite pixel 22*b* and not the object pixel 22*a* in accordance with high initial speed vector. Further, is there given a condition that an electric field exceeding the Paschen Rule's limit is imparted? Even if it is not given, an electric field close to the limit line is given, thus causing spark discharge or increasing unstable electric field imparted.

On the basis of the above-described problems, the principle of the present invention will be described hereinafter.

Figure 4:
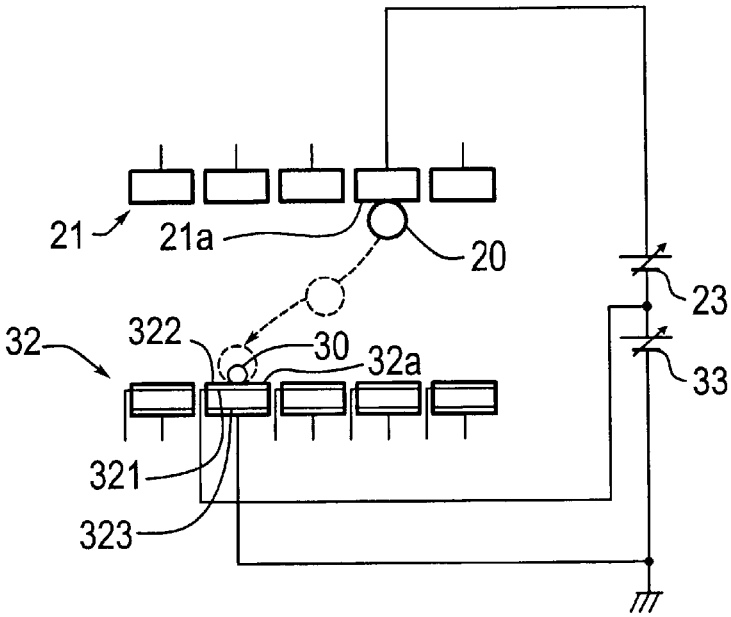
FIG. 4 is a view showing a structure by a combination of particle driving using an electric field with reduced diameter using generated Joule heat.

FIG. 4 represents a particle reducing process in which movement, flying and transfer are performed by an electric field, and Joule heat is utilized.

First, the description will be made of a reduction process of the particle 20. The particle 20 in the example shown in FIG. 4 has the property of reducing its diameter by being heated as one of its characteristics, and a particle having a ratio of expanding a particle having its specific gravity before expansion of about 1.2 to 1.3, by 5 to 35 times to have specific gravity of 0.04 to 0.2 was used for the actual experiment. As a range of reduction ratio usable, if the reduction ratio is substantially within a range 1/5 to 1/50 times, it can be said to be an appropriate range for an image forming process in equilibrium with the particle conveying speed imposed on the particle conveying member.

FIG. 4 shows that an image carrier 32 is characterized by combined-use structure in which it is used both as an electric field imparting electrode for moving the particle 20 and as an electrode for suddenly heating an image carrier pixel, namely for generating Joule heat. An electric field caused by voltage 23 is imparted between the particle conveying member 21 and a pixel electrode 32*a* of the image carrier 32. On the other hand, a pixel device 32*a* has a multi-player structure in which Joule heat generating material 321 is interposed between an electrode 322 and an electrode 323 up and down like a sandwich, and therefore, the pixel device 32*a* also functions as a Joule heat generating device when voltage is applied across both electrodes 322 and 323 by power supply 33. This function causes the particle 20 to be first shot onto the electrode 32*a* as the object pixel by the driving force caused by the electric field, and the particle 20 suddenly reduces by the energisation to the electrode 32*a* and a sudden temperature rise by Joule heat to become a particle 30 having the size of the final pixel.

Figure 5:
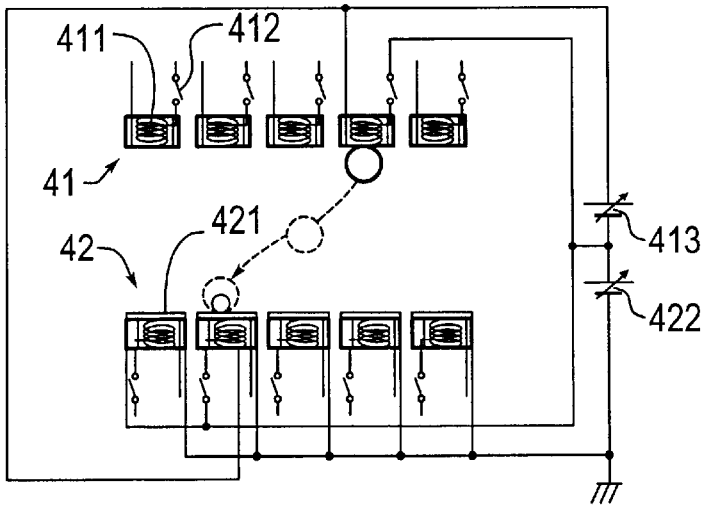
FIG. 5 is a view showing a structure by a combination of particle driving using a magnetic field with reduced diameter using generated Joule heat.

FIG. 5 shows a case of a magnetic particle whose particle 20 has the property of reducing its diameter by being heated.

Individual pixel devices constituting a particle conveying member 41 are magnetic field generating devices each consisting of a coil 411, a switch 412 which operates in response to an image signal, and voltage 413 imparted to the coil 411. An image carrier 42 is also constituted as a magnetic field generating device as in the case of the particle conveying member 41, but the top layer portion of each pixel device constituting the image carrier 42 is a heating resistive layer 421 for imparting heat to the particle 20.

Figure 6:
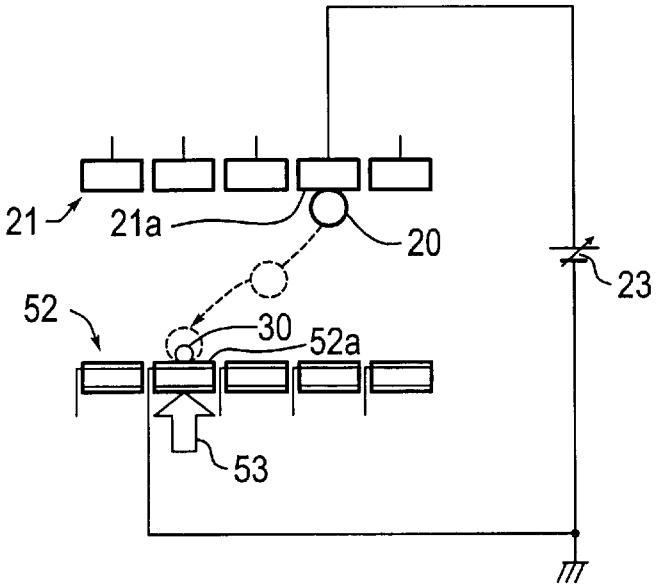
FIG. 6 is a view showing a structure by a combination of particle driving using an electric field with reduced diameter using heat generated by light irradiation.

FIG. 6 shows structure in which the moment the particle 20 is shot onto an object pixel 52*a* on an image carrier 52, impulse light 53 is imparted from the back to suddenly generate heat for reducing the diameter of the particle 20 once for all. The driving force for moving the particle 20 is an electric field.

Figure 7:
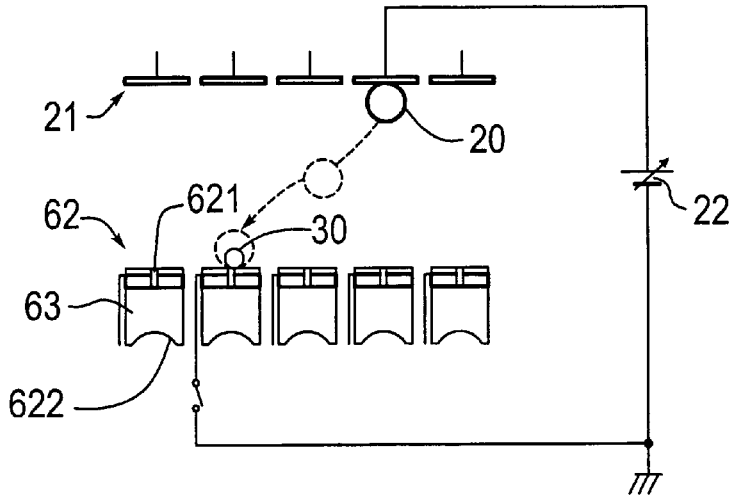
FIG. 7 is a view showing a structure by a combination of particle driving using an electric field with reduced diameter using limonene liquid.

FIG. 7 shows structure in which theparticle 20 is reduced by wetting the particle 20 with limonene liquid 63. The driving force for moving the particle 20 is an electric field. A pixel device on an image carrier 62 is a device for each pixel having a closed chamber filled with limonene liquid 63, and a pore portion 621 is provided on a part of the pixel onto which the particle 20 is shot. Substantially the moment the particle 20 is shot onto the object pixel on the image carrier 62, a pressing valve 622 is deformed so as to generate such pressure as to press out the limonene liquid 63 from the pore portion 621 toward the particle 20, whereby the limonene liquid 63 is to cover the surface thereof instantaneously.

Figure 8:
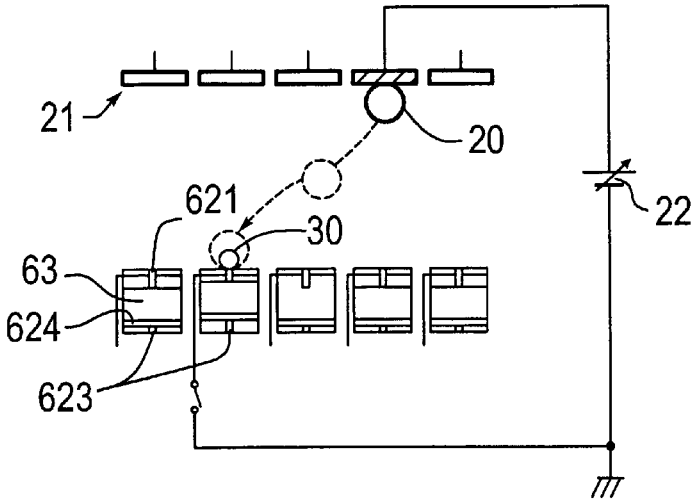
FIG. 8 is a view showing another structure by a combination of particle driving using an electric field with reduced diameter using limonene liquid.

FIG. 8 shows, as in the case of FIG. 7, structure in which the particle 20 is reduced by wetting the particle 20 with limonene liquid 63. However, instead of pressing out the limonene liquid 63 by the pressing unit 622 shown in FIG. 7, each pixel device constituting the image carrier is constructed such that a pressing valve 624 is pressed by a lamination type PZT623 to press out the limonene liquid 63 within.

As shown in each of the examples described above, the present invention is characterized by the fact that particles whose diameter reduces when subjected to a stimulus are used to individually control those particles.

One of the merits on adopting a particle whose diameter reduces when subjected to a stimulus is to be able to reduce its specific gravity to about 1/5 to 1/50 by comparing with, for example, polyester, which is general color toner material, normally to 1/10 to about 1/30. This means that, as shown in each example of FIGS. 4 to 8, it becomes possible to reduce the driving forces for causing the particle 20 to move, fly and adhere, and it is possible to impart as low an electric field as that. When the particle 20 can have charge under the same condition as toner, or when the particle 20 is allowed to have charge under such a condition, assuming the amount of charge which the particle has to be q, the gap to be y, the acceleration to be α, and time required to be t, the following equations can be established.

$$F=q\cdot E \rightarrow E=F/q \quad (1)$$

$$F=m\cdot\alpha \quad (2)$$

The acceleration α immediately before the particle 20 lands is represented by the following equation:

$$\alpha=2y/t^2 \quad (3)$$

If the gap y between the particle conveying member and the image carrier and time required to move the particle 20 are determined, the final acceleration α of the particle 20 can be obtained. If α is obtained, a force F required to move the particle 20 can be calculated. In order to produce the same F, the potential E can be lowered by an amount of charge q greater from equation (1). With reference to the toner amount of charge, a portion larger in diameter of the particle 20, i.e., an amount of charge (that is, the square of a ratio of the particle diameter of a particle used in the present invention to the diameter 7 μm of general toner) proportionate to the surface area can be retained. One of the characteristics of the present invention is that a large-diameter particle is used to reduce the mass, and an extra surface area is produced and an amount of charge for the portion thus increased is caused to be retained to allow the electric field required to be suppressed low. This applies to a magnetic force to which a magnetic particle in a uniform parallel magnetic field is subjected, and since it is determined by the magnetic force of the magnetic particle per unit area in the uniform parallel magnetic field, it is possible to obtain the magnetic force by the cube of the ratio in particle diameter. In the case of the magnetic field, any phenomenon affecting particle behavior is not found, but in the case of the electric field, there is a spark discharge phenomenon based on the Paschen Rule. In other words, to suppress the electric field as low as possible is a process of moving a particle by impartation of stable voltage which causes no spark discharge.

In abrasion (bursting phenomenon) by sudden irradiation of light or impartation of heat, the force for moving a particle is finally pressure. Since the pressure is naturally proportionate to the area, the driving force is determined by the projected area of the particle. The present invention takes advantage of the lucrative point that the force of driving the particle is squared or cubed by making the particle diameter several times larger than the size of the final pixel in this way in advance.

Next, the description will be made of particles suitable for the object of the present invention and a method therefor.

The particles suitable for the object of the present invention are roughly divided into expanded particles, flocculation particles and expanded film particles.

(Expanded particle)

With thermoplastic macromolecular polymer such as polystyrene, styrene-acryl ester copolymer, polyester resin, polyamide resin, polyacrylate, polyvinylidene chloride, polyacrylonitrile, and polymethyl methacrylate as raw particles (original particles), several percent (about 5%) of volatile expanding agents such as isobutane and n-pentane, coloring material such as dye and pigment, and in some instances, chemical destaticizer or the like are caused to be included, and are suddenly heated to about 100° C. to thereby cause cells to grow within. Thereafter, when gradually cooled, the expanding agents such as butane and pentane in the cells are replaced with air around the particle to cause voids within the cells.

Also, as another method, it may be possible to produce by causing macromolecular material such as styrene resin and vinyl resin to dissolve in solvent such as xylene, and adding an expanding agent thereto. As the macromolecular material used for this method, solvent-soluble thermoplastic resin is most generally used. As the expanding agent, there are organic and inorganic agents such as zinc peroxide, calcium peroxide, barium peroxide, sodium peroxide, sodium bicarbonate, potassium bicarbonate, calcium azide, diazoaminobenzene, azoisobutyro-dinitrile, benzenesulfohydrazine, and dinitrosopentamethylenetetramine.

Figure 9:
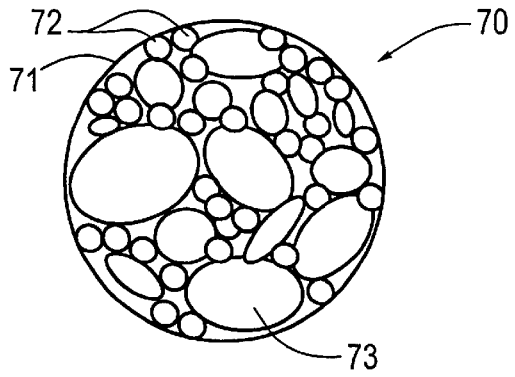
FIG. 9 is a schematic diagram showing an expanded particle.
Figure 10:
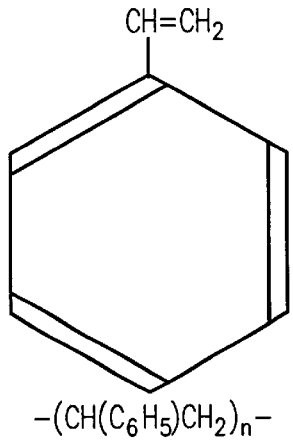
FIG. 10 is a molecular structural view for expanded styrene.

FIG. 9 is a schematic view showing an expanded particle. This expanded particle 70 is obtained by dispersing coloring material 72 such as pigment and dye in expanded material (for example, expanded styrene (expanded polystyrene)) 71, and causing it to expand from the state for forming voids (cells) 73 within. Actually, the coloring material 72 enters the cell 73 during the expanding process. In the case of expanded styrene (expanded polystyrene), it has the structure shown in FIG. 10, and is colorless, transparent, non-crystalline thermoplastic resin having nearly the same one as the original specific gravity of $d^{23}$=1.05 to about 1.07. The glass transition temperature is about 70 to 82° C., and it begins melting at about 165° C., and the resin completely melts and reduces at 200° C. The melting and reduction mechanism is attributed to the fact that the styrene molecular chain is released by heat, and the fact that the air in the cell within the expanded styrene particle is released and the pressure becomes lower than the air pressure around the particle so that the cell within is flattened by the physical pressing force caused by the ambient atmospheric pressure. Basically, the shrinkage factor does not exceed the initial expansion coefficient of the particle, and therefore, it cannot have a particle diameter equal to or less than the original particle diameter.

Flocculation Particles)

Latex emulsion polymerization resin particles(+surface-active agent) of 0.1 to about 1.0 μm such as styrene acryl and polyester, and dye/pigment particles, and in some instances, wax particles (+surface-active agent) to make a sheet, etc. oilless are mechanically agitated in the solvent at room temperature of about 25° C. The emulsion polymerization resin particles and dye/pigment are material-selected to have electrically opposite polarity from the beginning, and nuclei for flocculating are produced by this mechanical agitation. Further, they are caused to grow into flocculation particles of 1 to about 100 μm while adding latex particles at a temperature of about Tg (about 60° C.), and thereafter, are heated at a temperature of 90 to 100° C. for four to six hours for stabilization. Then, high-temperature washing (about 70 to 90° C.), normal washing and drying are performed to obtain final flocculation particles.

Figure 11:
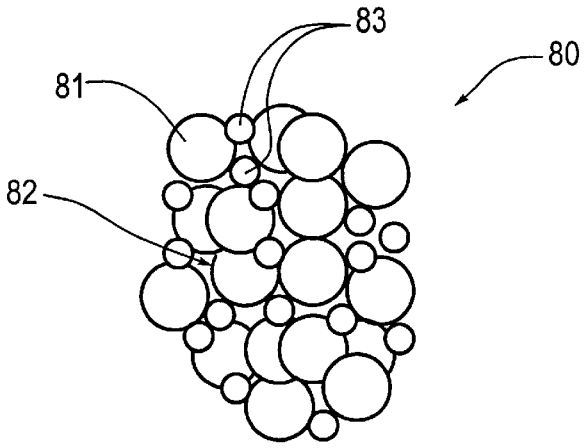
FIG. 11 is a schematic diagram showing a flocculation particle.

FIG. 11 is a schematic view showing a flocculation particle, and the flocculation particle 80 shown in FIG. 11 is obtained by flocculating fine macromolecular polymer particles 81 having a diameter of 0.1 to about 1.0 μm such as styrene acryl and polyester into a diameter of 1.0 to about 100 μm in accordance with the polymerization technique. The flocculation particle is constructed such that voids 82 caused between the fine macromolecular polymer particles 81 are filled with coloring materials 83 such as pigment and dye and binder resin or externally-added material to thereby eliminate voids 82 between the fine macromolecular polymer particles 81, and to enhance the binding power between the fine macromolecular polymer particles 81.

(Expanded Film Particles)

Particles obtained by causing macromolecular polymer such as styrene, styrene acryl and polyester to include coloring material particles such as dye/pigment and in some instances, wax particles or the like, are used as nuclei, and further particles obtained by causing the macromolecular polymer to include therein several percent (about 5%) of volatile expanding agent such as isobutane and n-pentane, chemical destaticizer and the like are formed in a particle shape state on the surface of the nuclei as an outer skin. Those particles are suddenly heated to about 100° C. to thereby cause cells to grow in the outer skin portion. Thereafter, when gradually cooled, the expanding agents such as butane and pentane in the cells are replaced with the air around the particles to cause voids within the cells. As described above, it is possible to thus form a nucleus including dye/pigment at the center of the particle in advance and to form an expanded macromolecular polymer layer around the nucleus as an outer skin. In the case of using liquid ink, this applies, and for material constituting the nucleus, material obtained by dispersing coloring material in wax resin such as hot melt adhesive may be used.

Figure 12:
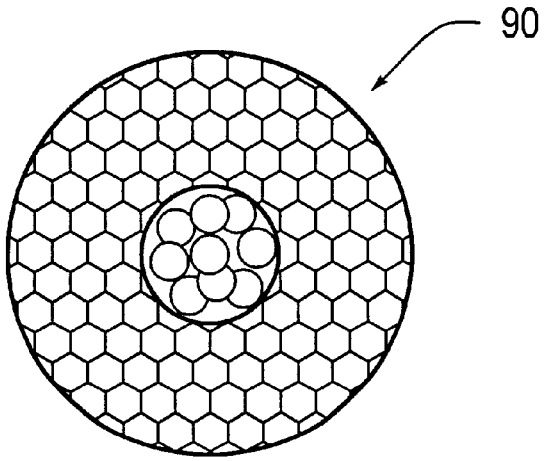
FIG. 12 is a schematic diagram showing an expanded film particle.
Figure 13:
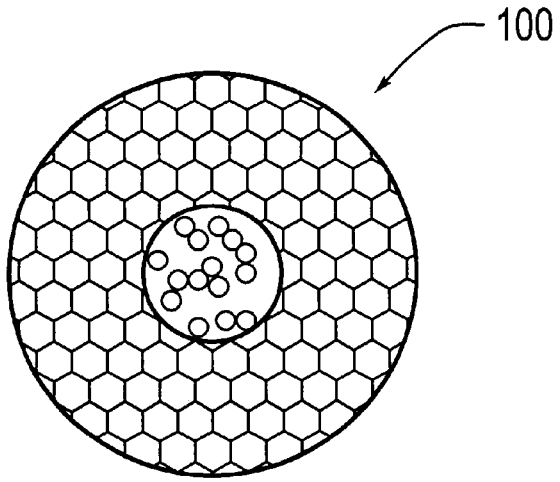
FIG. 13 is another schematic diagram showing an expanded film particle.
Figure 14A:
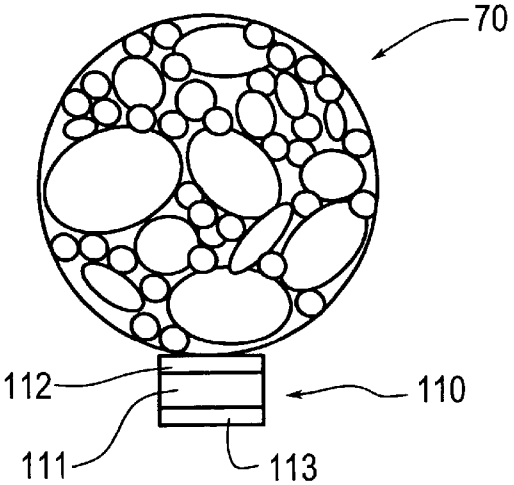
FIGS. 14(A) to 14(D) are views showing a process of particle reduction using Joule heat.
Figure 14B:
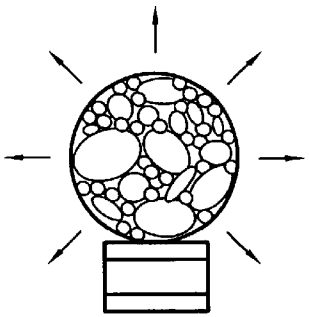
Figure 14C:
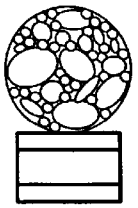
Figure 14D:
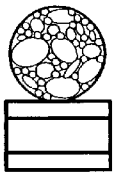

FIGS. 12 and 13 show a schematic view for an expanded film particle. The expanded film particle 90 shown in FIG. 12 has structure in which coloring material such as dye and pigment or binder resin, externally-added material and the like are housed in the central portion by an amount required to record at least the final pixel. Also, the expanded film particle shown in FIG. 13 has structure in which the ink liquid having coloring material such as pigment and dye dispersed in the solvent is housed at the substantially central portion by the minimum amount dissolved required to record the final pixel.

Next, the description will be made of a shrinkage process of a particle.

FIGS. 14(A) to 14(D) are views showing a particle shrinkage process using Joule heat.

A heating device 110 has multi-layer structure consisting of a heating element 111 using energisation and electrodes 112 and 113 in which the heating element 111 is interposed therebetween up and down. When voltage is applied across the electrodes 112 and 113 in response to an image signal, the temperature suddenly rises through current flowing through the heating element 111. When the expanded particle 70 suddenly absorbs heat generated at this time, a shrinkage phenomenon occurs as shown in FIG. 14 (A)→FIG. 14 (B)→FIG. 14(C)→FIG. 14(D).

Figure 15:
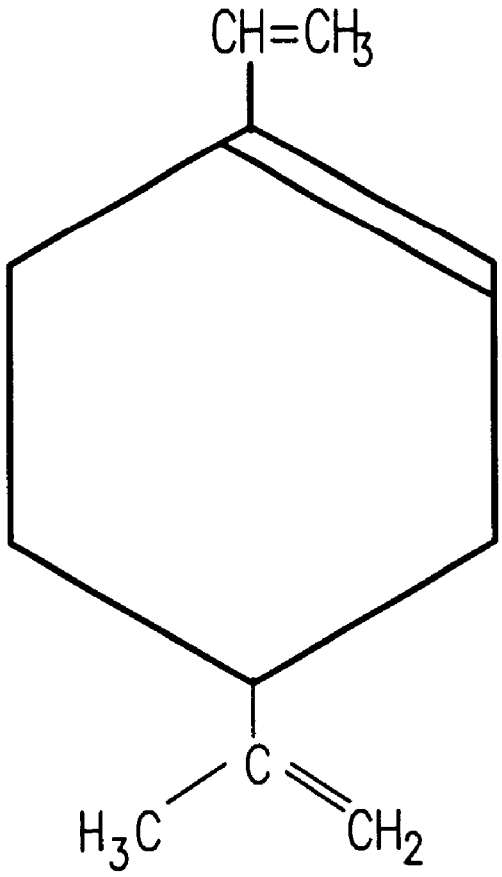
FIG. 15 is a molecular structural view for limonene.
Figure 16D:
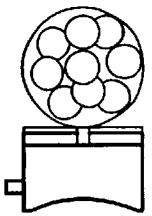
FIGS. 16(A), 16(B), 16(C) and 16(D) represent a view showing a process of particle reduction using limonene liquid.
Figure 16C:
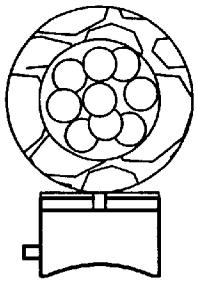
Figure 16B:
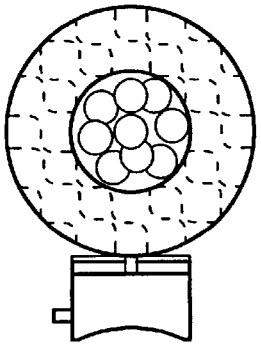
Figure 16A:
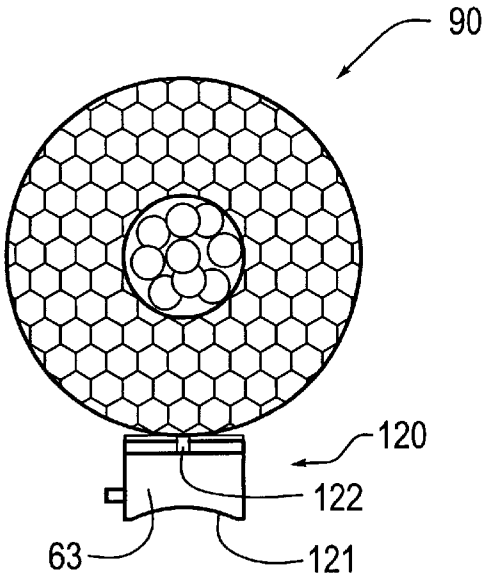

A chemical melting and shrinkage phenomenon by wetting a particle with limonene liquid may be utilized. The limonene is one of monocyclic monoterpenes as shown in FIG. 15, and is derived from p-menthane. This is lemon-like fragrant, colorless transparent liquid having optica lisomer d and 1. The d member is extracted from natural products contained in orange-peel oil, lemon oil, bergamot oil, fennel oil and the like, and therefore, it has a great advantage that there are hardly apprehensions concerning safety aspects. The inhalation toxicity is about 5 g/kg (body weight), and sufficient safety can be secured in view of usually general toxicity level for organic solvent being on the order of mg order. FIGS. 16(A) to 16(D) show a process of dissolving and reducing the expanded styrene particle by wetting with limonene liquid greater than 95% pure. In FIGS. 16(A) to 16(D), the expanded film particle 90 shown in FIG. 12 has moved from a particle conveying member (not shown) and is adhering onto a device 120 in units of pixels having a closed chamber filled with the limonene liquid 63. By deforming a pressing valve 121 so as to generate pressure which presses out the limonene liquid 63 from a pore portion 122 toward the particle 90 substantially upon the adhesion of the particle 90 onto the device 120, the limonene liquid 63 will instantaneously cover the surface of the particle 90. The surface material may be selected in advance so that the wetting between the limonene liquid 63 and the surface of the particle 90 is performed properly, or the surface may be subjected to a multi-cellular process in advance so as to cause the limonene liquid 63 to easily wet with a capillary force. FIG. 16(A) shows the moment when the particle 90 lands on the device 120, FIG. 16(B) shows a state in which the limonene liquid 63 starts wetting, the molecular chain of the expanded material at the outer periphery is gradually released, and the particle diameter has reduced, FIG. 16(C) shows a state in which the release of the molecular chain considerably advances, and the viscosity has increased while spreading in the limonene liquid, and FIG. 16(D) shows a state in which almost all expanding agents have dissolved and are turned into transparent film, and coloring material such as pigment and dye and binder resin remain by an amount of coloring material required for recording the final pixel on the pixel portion.

Figure 17:
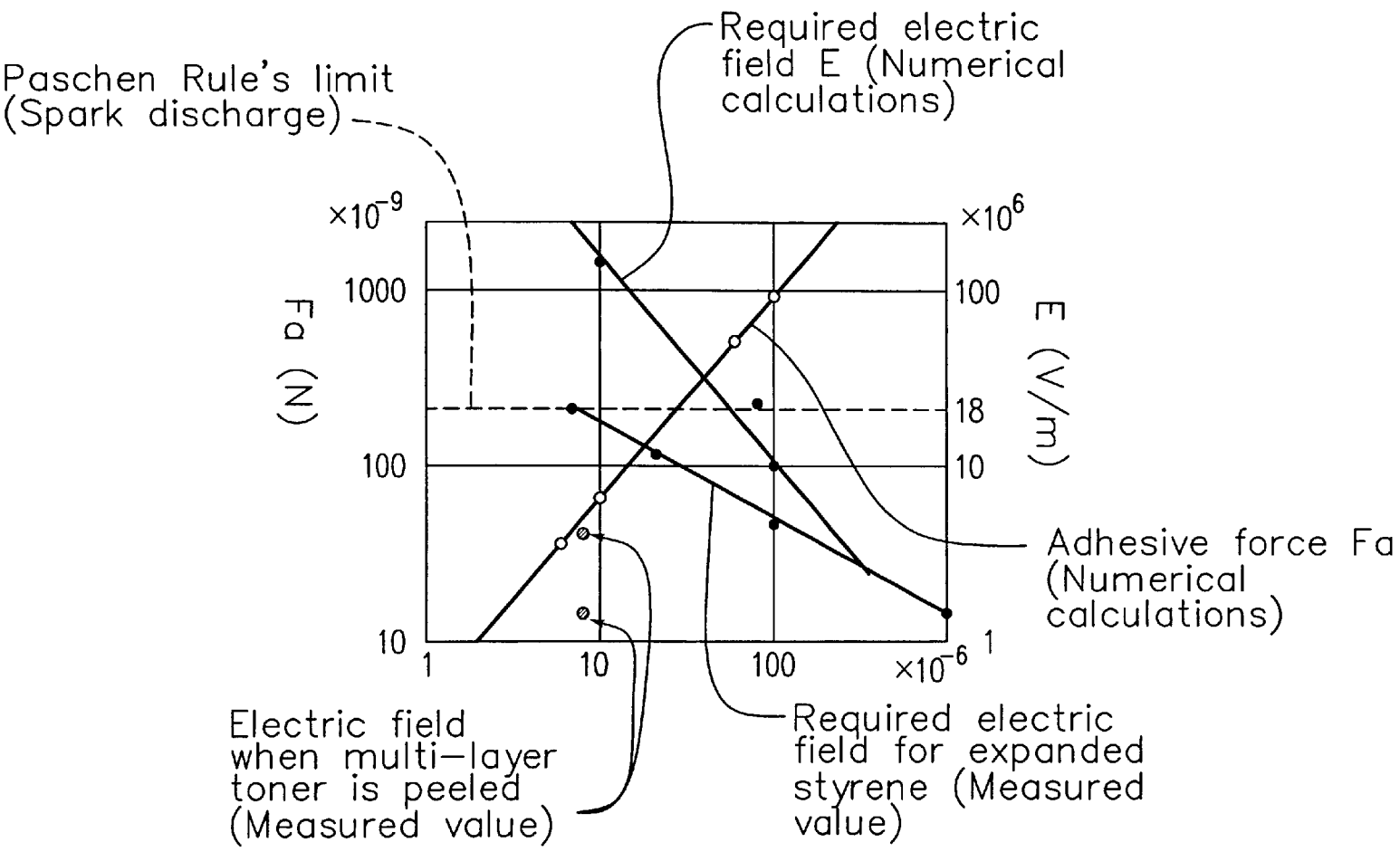
FIG. 17 is a view showing the experimental result obtained by verifying the reduction effect of an electric field imparted.

FIG. 17 shows the experimental result for verifying the reduction effect of an electric field imparted according to the present invention. The axis of abscissas represents the diameter d of the particle, the left side of the axis of ordinates represents an adhesive force Fa caused by the van der Waals force, and the right side thereof represents an electric field required to overcome the van der Waals force for moving the particle. In, for example, color toner having a diameter of 7 $\mu$m for electrophotography, in the case of a single-layer deposit, it conflicts with the Paschen Rule's limit and causes spark discharge. In the case where toner is stacked in multi-layer, however, it moves at a considerably low electric field. This is because the adhesive force between the toner themselves is weak because of the spherical shape and the toner has a tendency to easily peel immediately particularly for a shear force. In the case of a single-layer deposit for color toner having a diameter of 7 $\mu$m for electrophotography, the required electric field exceeds $100\times10^6$ (N), which much exceeds the Paschen Rule's limit of $18\times10^6$ (V/M). On the other hand, when the diameter of the expanded ethylene sphere is continuously increased, it can also be seen from the experimental result that the required electric field has been reduced to the square of the ratio of the particle diameter although the adhesive force with a particle supporting member increases somewhat. In other words, according to the present invention, the electric field required to move the particle can be reduced by at least one order of magnitude as a result.

The description on the principle of the present invention has been terminated, and embodiments according to the present invention and related matters thereto will be described.

Figure 18:
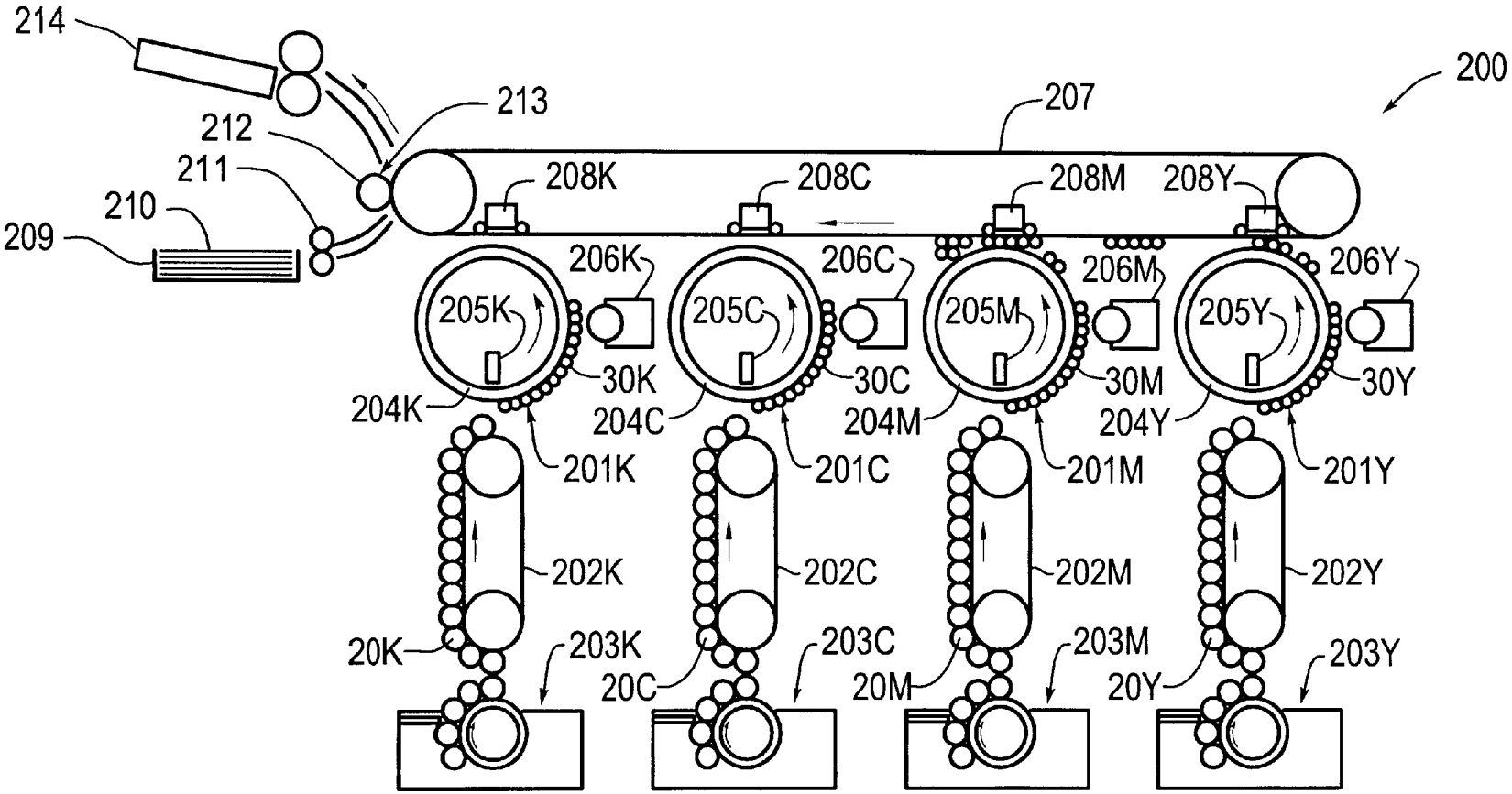
FIG. 18 is a structural view showing a color image forming apparatus, which is an embodiment of an image forming apparatus according to the present invention.

FIG. 18 is a structural view showing a color image forming apparatus, which is an embodiment of an image forming apparatus according to the present invention.

The color image forming apparatus 200 shown in FIG. 18 comprises: particle conveying belts 202Y, 202M, 202C and 202K for carrying each color (yellow Y, magenta M, cyan C and black K) of large-diameter particles 20Y, 20M, 20C and 20K (about 100 $\mu$m in diameter) on the surface thereof and conveying to particle moving positions 201Y, 201M, 201C and 201K corresponding to each color respectively; and particle supplying devices 203Y, 203M, 203C and 203K for supplying the particles 20Y, 20M, 20C and 20K onto those particle conveying belts 202Y, 202m, 202C and 202K.

In this respect, when the same components corresponding to each color are generally designated in the following, Y, M, C and K representing the distinction of color are omitted as stated as follows: particle 20 and particle conveying belt 202.

Figure 19:
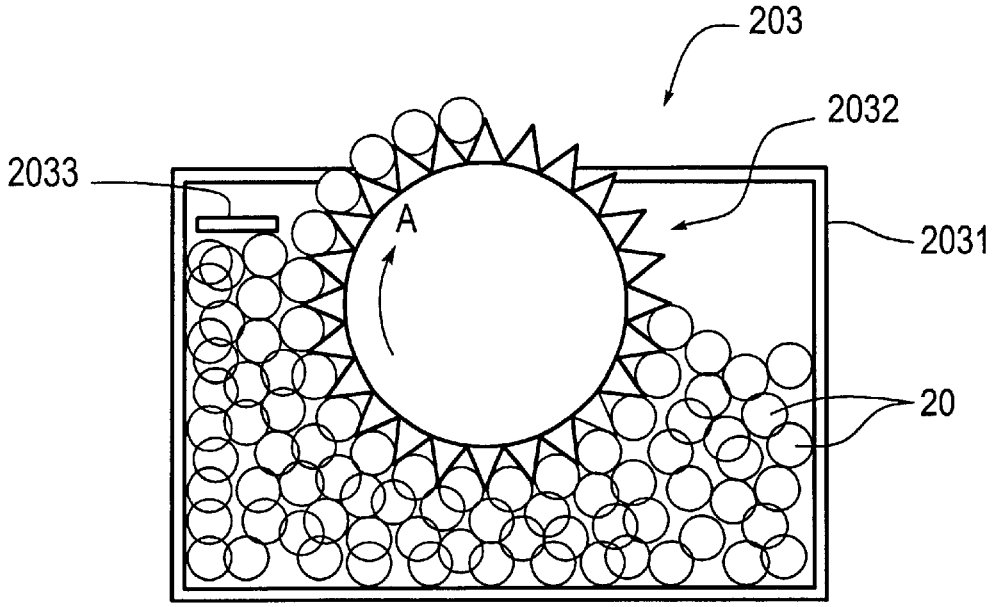
FIG. 19 is a structural view showing a particle supplying device.

FIG. 19 is a structural view showing the particle supplying device.

The particle supplying device 203 comprises: a particle storage 2031 for containing large-diameter particles 20; and a cylindrical roller 2032 whose surface is formed with projections and depressions into a triangular shape with an about 100 $\mu$m pitch, and the surface layer of the cylindrical roller 2032 is coated with silicone which improves the mold release characteristics from the large-diameter particles 20. The particles 20 are stored within the particle storage 2032, and the cylindrical roller 2032 rotates in a direction indicated by an arrow A. Then, exactly one piece of the particle 20 fits into a concave portion on the triangular surface of the cylindrical roller 2032, and any extra particles 20 are removed by a scraper 2033. In this way, a uniform thin layer consisting of the particles 20 is formed on the cylindrical roller 2032. The uniform thin layer thus formed is transferred onto the particle conveying belt 202 shown in FIG. 18 by the tack strength between it and the particle conveying belt 202. This utilizes the adhesive force based on the van der Waals force, and since the adhesive force between the particle 20 and the cylindrical roller 2032 is coated with, for example, silicone, it is very weak. Therefore, the particle 20 can be easily carried on the particle conveying belt 202. As an acting force to move the particle 20 at this time, any of an electrostatic force, a magnetic force, pressure and the like in addition thereto may be used, and there are no problems even if they are combined for use.

The particles 20 conveyed to a particle moving position 201 by the particle conveying belt 202 are moved to intermediate recording media 204Y, 204M, 204C and 204K each having a drum shape which are opposed to the particle conveying belt 202 at the particle moving position 201. The intermediate recording medium 204 for each color has discrete structure in which it is divided into pixels having a predetermined pixel area, and is constituted with a 10 to 20 $\mu$m pitch so as to correspond to 1200 to 2400 dpi. Upon arrival at the particle moving position 201, the particle 20 conveyed by the particle conveying belt 202 moves to a position on the intermediate recording medium 204 in response to an image signal, by the action of an image storing device 205 which performs the operation in response to the image signal, and a stimulus for reducing the diameter of the particle 20 is imparted to the particle moved on the intermediate recording medium 204. In other words, this image storing device 205 has both a particle moving part and a particle diameter reducing part in the present invention. The image storing device 205 in this embodiment has such structure as shown in FIG. 4. The large-diameter particle 20 is caused to move and fly by an electrostatic force, and substantially the moment the large-diameter particle 20 is shot onto an object pixel on the intermediate recording medium 204, the large diameter particle 20 is imparted with Joule heat instantaneously to become a reduced particle 30, whose diameter has reduced. At this time, the particle diameter is generally reduced to 1/5 to 1/30.

After an image is formed on the intermediate recording medium 204 by the image storing device 205, the image is tentatively immobilized by tentative immobilization units 206Y, 206M, 206C and 206K in preparation for the transfer onto an intermediate transfer belt 207 consisting of macromolecular polymer film (about 50 to 300 $\mu$m in thickness) such as polyester, polycarbonate and polyethylene terephthalate. The tentative immobilization here is to tentatively fix the physical relationship among the reduced particles 30 to prevent an image based on the reduced particles 30 from being easily collapsed. A general way for tentatively immobilizing an image formed is to utilize the flocculation force of a particle itself by heat fusion. In the tentative immobilization unit 206 shown in FIG. 18, tentative immobilization using irradiation of a halogen lamp is performed. When the particle 30 is heated at a temperature of about 100 to 120° C., it does not enter a completely-flocculated and fixed state, but is formed in a thin film shape. Of course, the surface physical properties of the particle 30 and the intermediate recording medium 204 are appropriately selected in advance so as to have good mold release characteristics between the film-like image formed and the surface of the intermediate recording medium 204. In addition to this laminating process, any of coating the image consisting of the reduced particles 30 with adherent material, forming a liquid film using appropriate solvent to immobilize with its crosslinking force, and the like may be used. Also, without specially providing the tentative immobilization unit 206, it may be possible to use heat for reducing the particle 20 which is produced at pixel electrodes on the intermediate recording medium 204 for melting and tentatively immobilizing at the same time. Within the intermediate transfer belt 207, there is provided a heat head 208 for superposing images of each color on the intermediate transfer belt 207. On receipt of a signal from a detection sensor (not shown) for registering the tip ends of images for each color formed on the intermediate recording medium 204, voltage is applied to each heat head 208Y, 208M, 208C and 208K and heat is imparted from the back of the intermediate transfer belt 207. Of course, the image may be moved by the electrostatic force, and in this case, there can be used an intermediate member transfer belt adjusted to surface resistance $\rho_s \approx 10^{10} \sim 10^{12}$ $\Omega/\square$ and volume resistance $\rho_v \leqq 10^{13}$ $\Omega \cdot$cm by causing carbon to knead with, for example, polyimide. Besides, it is needless to say that the acting force such as a magnetic force and pressure may be used.

An image color-superimposed on the intermediate transfer belt 207 becomes a full-color image, and proceeds to the next final process, i.e., a transfer process onto a sheet. In a sheet cassette 209, sheets 210 are stored, and the sheets 210 are fed out from the cassette 209 one sheet at a time to stand ready at the position of a registration roller 211 on receipt of an instruction from a sheet conveying timing sensor (not shown). The registration roller 211 starts to move so as to time to the tip end of the image on the intermediate transfer belt 207 so that the sheet 210 is conveyed to a nip portion 213 interposed between a transfer roller 212 and the intermediate transfer belt 207. The transfer roller 212 is, for example, a heat roller having a heat source therein, and heat fusion and adhesion are performed at a temperature of about 150° C. to perform final fixing onto the sheet 210. Thus, the color image is transferred onto the sheet 210, and is discharged to a discharge cassette 214 to terminate a series of processes.

Figure 20:
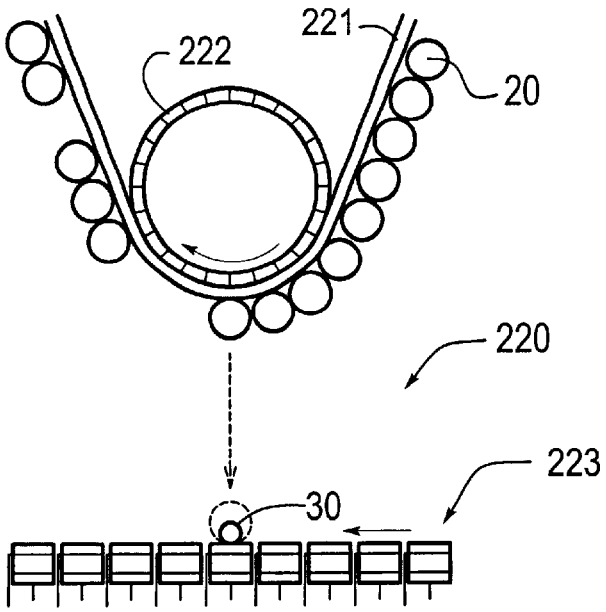
FIG. 20 is a view showing an example of components of the particle 20 relating to movement and reduction.
Figure 21:
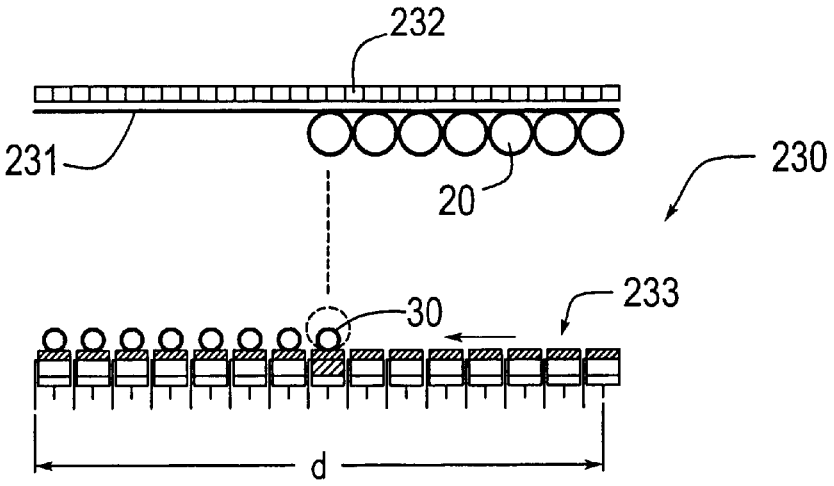
FIG. 21 is a view showing an example of components of the particle 20 relating to movement and reduction.

FIGS. 20 and 21 are views showing each example of components concerning movement and reduction of the particle 20.

FIG. 20 shows a case where a line (band width) in which a particle 20 moves from a particle conveying belt 221 to an intermediate recording medium 223 and reduces is one line. A large-diameter particle 20 is carried on the particle conveying belt 221 to be conveyed to a particle moving position 220. On the back of the particle conveying belt 221, there is arranged a back roller 222, and any of various driving forces and the particle diameter reducing mechanism which have been described until now is acting on the particle 20 between the back roller 222 and the intermediate recording medium 223.

FIG. 21 represents a case where a mechanism for movement of particles and movement of particle diameter is caused to act over some lines instead of movement and reduction of particles on one line, and there exists a certain width d, in which the particle 20 can be moved and reduced, at a particle moving position 230 interposed between a particle conveying belt 231 and an intermediate recording medium 233.

On the back of the particle conveying belt 231, there are arranged electrodes 232 with the same size as the diameter of for example, a large-diameter particle 20 for the movement of the large-diameter particle 20 over the width d.

When it takes time to move the particles, or when there exists a condition in which the particle moving speed cannot be increased, some lines are taken in the process direction whereby the productivity of the image is actually ensured.

Figure 22:
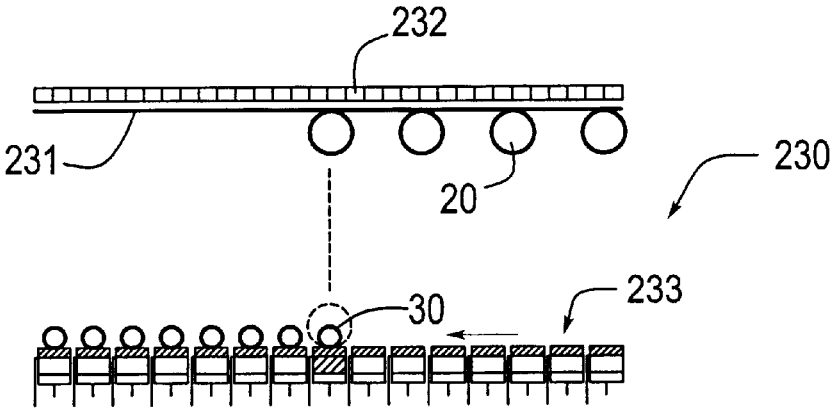
FIG. 22 is a view showing another example of components of the particle 20 relating to movement and reduction.

FIG. 22 shows the same structure as FIG. 21, but is different in that the large-diameter particles 20 on the particle conveying belt 231 are arranged spaced apart an interval between them. In this case, it is advantageous to exclude crosstalk (interaction between particles adjacent) to be described later. The structure for arranging large diameter particles 20 at intervals on the particle conveying belt 231 will be described later.

Figure 23:
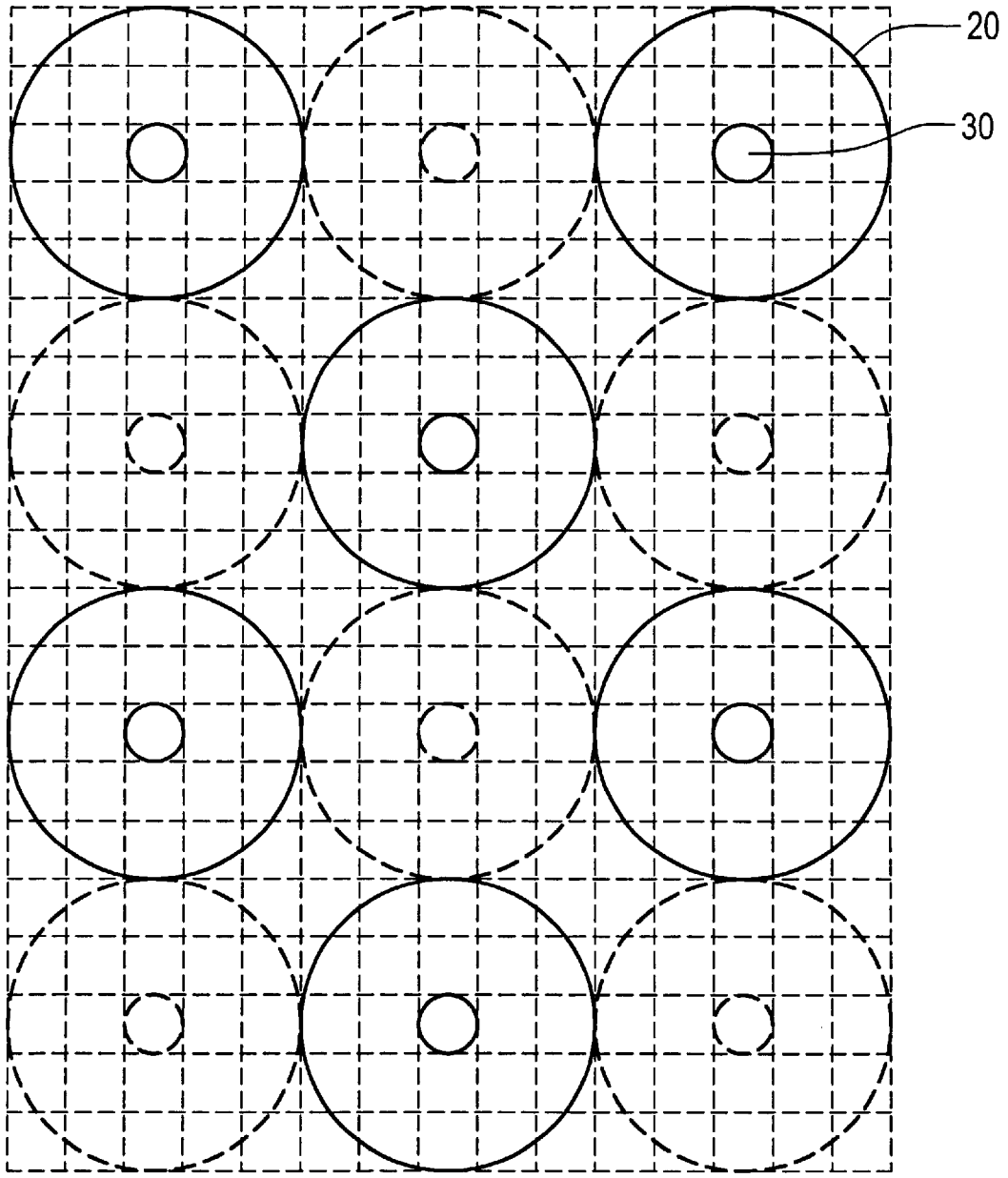
FIG. 23 is a schematic view when recording (movement of a particle) is performed over a particle moving area (width d shown in FIG. 21 consisting of a plurality of lines.

FIG. 23 is a schematic view when recording (movement of particles) is performed over a particle moving area (width d shown in FIG. 21) consisting of a plurality of lines. The conveying speed of the particle conveying belt depends on the reduction ratio of the particle. Namely, even in the case of recording as a single line as shown in FIG. 20, the particle supplying speed using the particle conveying belt must be at least the square of the inverse of the reduction ratio of the particle. In the case of, for example, recording on a A4-size sheet in portrait orientation (conveyed with the 210 mm-side as the side at the tip end) in 1200 dpi full line, 10,500 pieces of particles must be arranged with the final pixel diameter of 20 $\mu$m. However, assuming the particle diameter of the large-diameter particle supplied from the particle conveying belt to be 100 $\mu$m, the particle reduction ratio becomes 1/5, and only 2,100 pieces of particles can be placed even if arranged in full line. In other words, unless the speed at a side of supplying the large-diameter particles is five times in the process direction, five times in the lateral direction and a supplying speed of 5×5=25 times in total is given, it will not catch up with the requirement.

Also, even if driven every other particle in order to exclude the in teraction (cross-talk) of the driving forces between adjacent particles of the large-diameter particles 20 having a diameter of 100 $\mu$m on the particle conveying belt as shown in FIG. 23, the supplying speed will not be affected if the particles 20 on the particle conveying belt are formed to be closely adjacent to each other. In other words, in the above-described example, the supplying speed of 5×5=25 times may be used. If, however, the particles 20 on the particle conveying belt are thinned out in advance and arranged, the supplying speed will be affected. Assuming that they are arranged, for example, every other particle , the number of particles which can be supplied becomes as half as 1,050 pieces per unit time. Since consideration must be given two-dimensionally: in the process direction and in the lateral direction, the supplying speed becomes 25×4=100 times.

Summarizing the foregoing concerning the particle supplying speed, (1) The square of the inverse of the particle reduction ratio will be multiplied as the supplying speed.

(2) In the case of moving the particles after thinning out them in consideration of the cross-talk, the supplying speed conforms to the above-described (1), but if the particle arrangement itself on the particle conveying belt is thinned out, the square of the inverse of the particle thinning-out ratio on the particle conveying belt will be multiplied.

It is an important point to study the above-described two items (1) and (2).

Next, a way of reducing the cross-talk itself will be described by exemplifying a case where an electric field is imparted.

Figure 24:
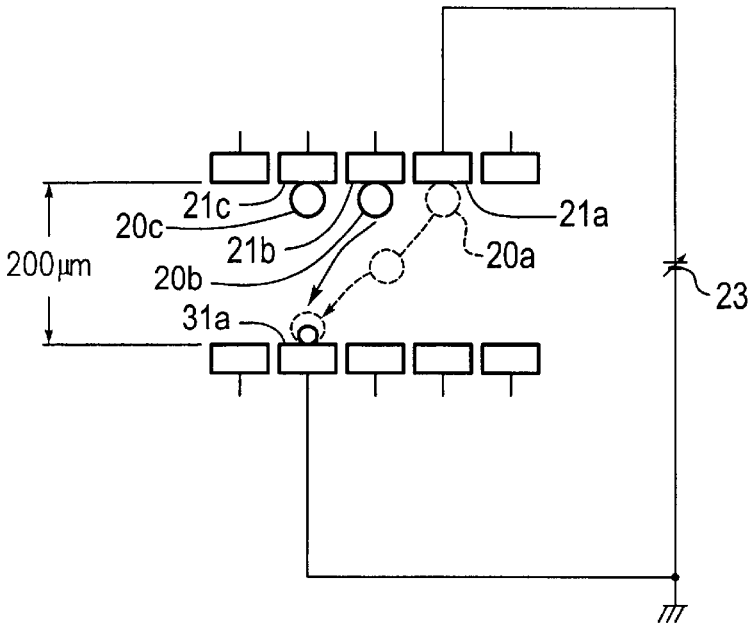
FIG. 24 is a view showing a state in which particles are arranged on three adjacent electrodes.
Figure 25:
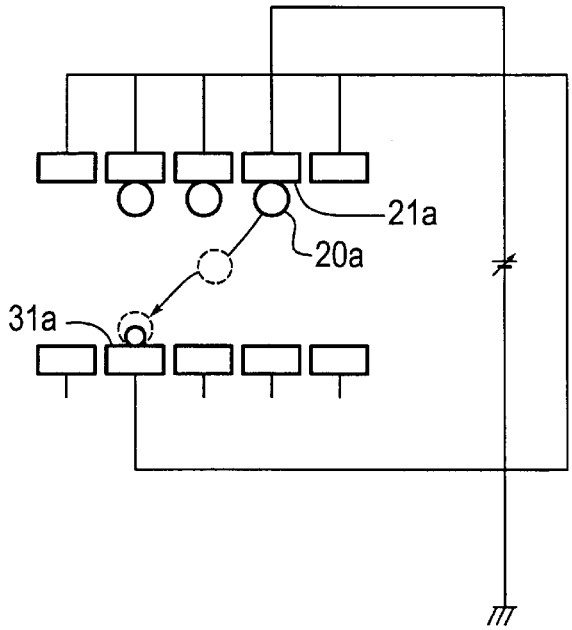
FIG. 25 is a view showing a state in which electrodes around are grounded in FIG. 24.
Figure 26:
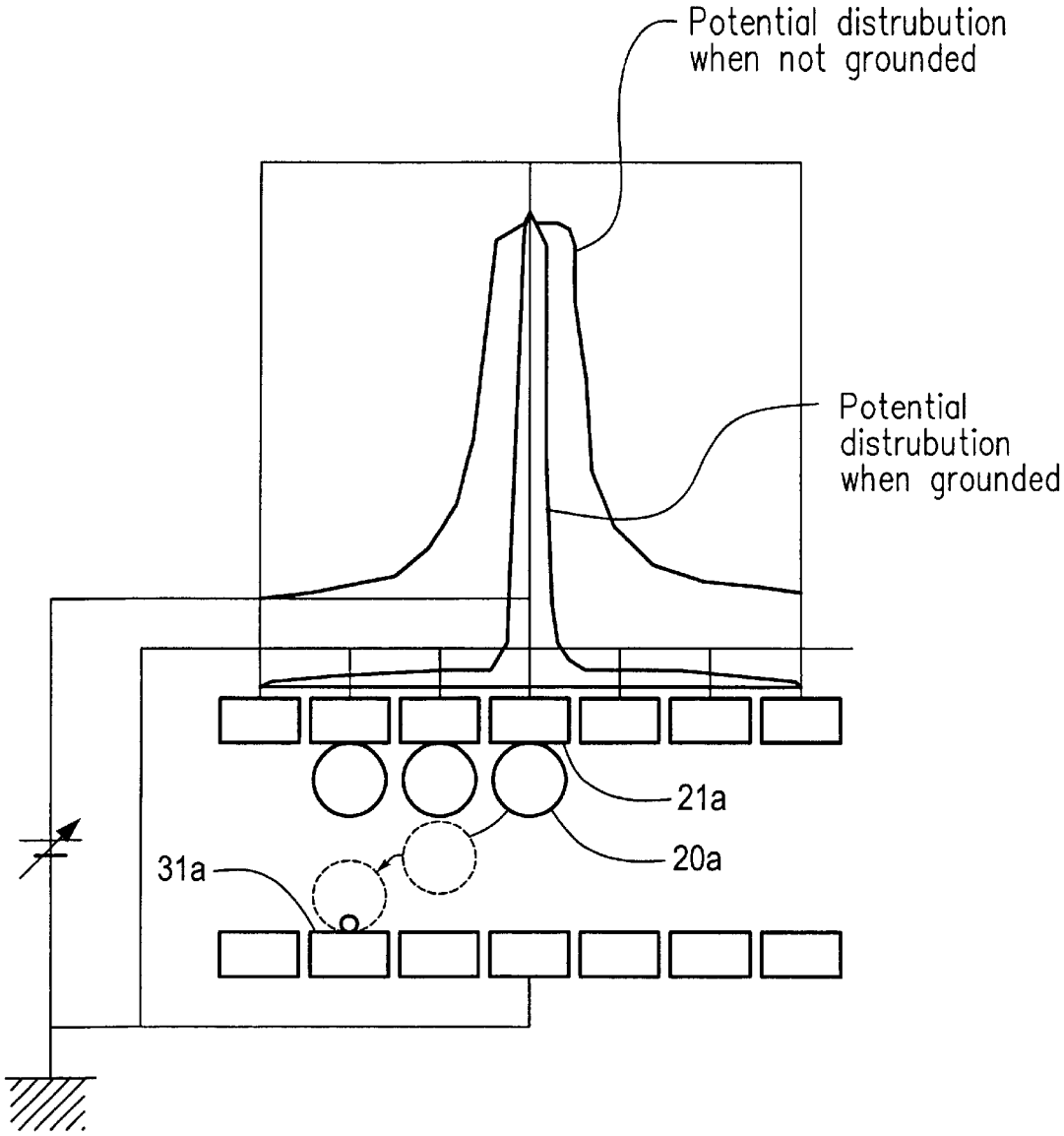
FIG. 26 is a view showing potential distribution when surrounding electrodes are grounded and when not grounded.

FIG. 24 is a view showing a state in which particles 20*a*, 20*b* and 20*c* are arranged on three adjacent electrodes 21*a*,

21*b* and 21*c* respectively, and in this state, it was very difficult to move only the particle 20*a* onto the object pixel 31*a*. As the conditions at this time, an attempt was made to move the particle with a gap of 200 μm, a particle diameter of 0.1 mm and an applied voltage within a range of 400 to 1700 V, but several tens to hundred tens V was developed as leakage voltage to the adjacent electrode 21*b*, a driving electric field was generated also from the adjacent electrode 21*b*, and the adjacent particle 20*b* also moved after all. Thus, in FIG. 25, peripheral electrodes other than the object electrode 21*a* are grounded, and in this case, it is possible to make the distribution of the leakage potential exceedingly narrow as shown in FIG. 26. Only the particle 20*a* driven thereby could be moved to a desired pixel (electrode 31*a*). This means that when an actual input image signal is inputted to a specified pixel electrode, it can be put in such an input mode that it is driven at least across one pixel.

Figure 27:
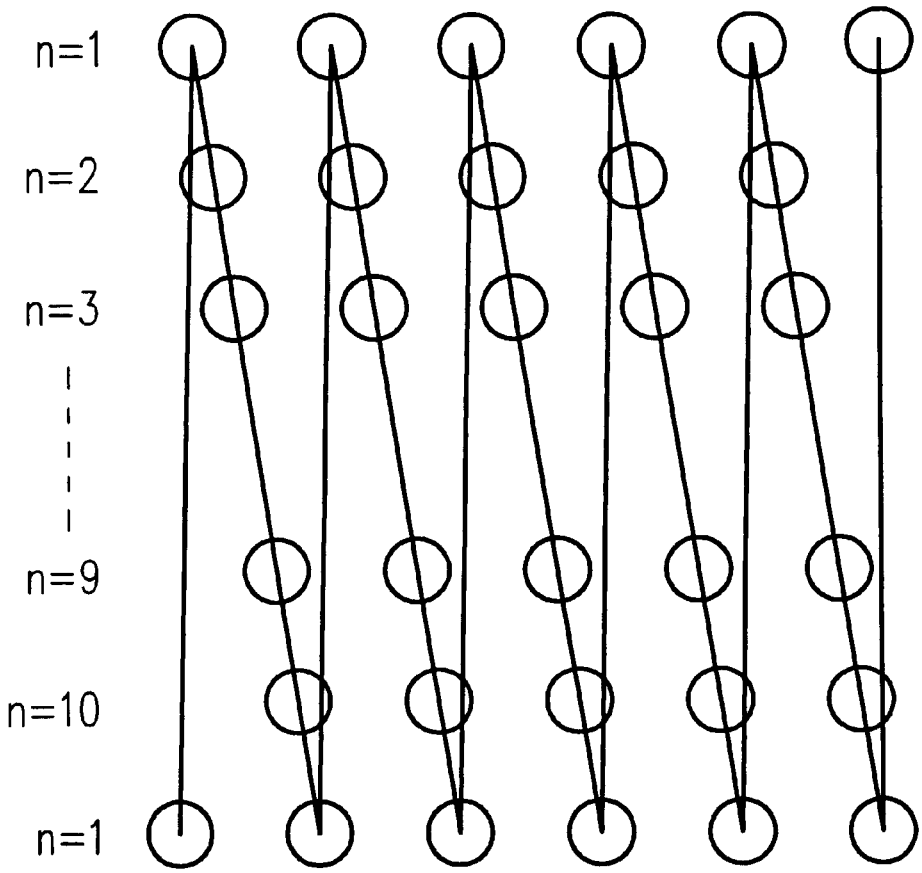
FIG. 27 is a view schematically showing a process in which the particles are caused to move every other particle with a recording width of a 10-line width in the process direction.

FIG. 27 is a view schematically showing a process of moving with a recording width (width d shown in FIG. 21) of a 10-line width every other particle in the process direction.

By successively moving particles using a 10-line (n=1, 2, . . . 10) width in this way, it is possible to move the particles while preventing any cross-talk.

Figure 28:
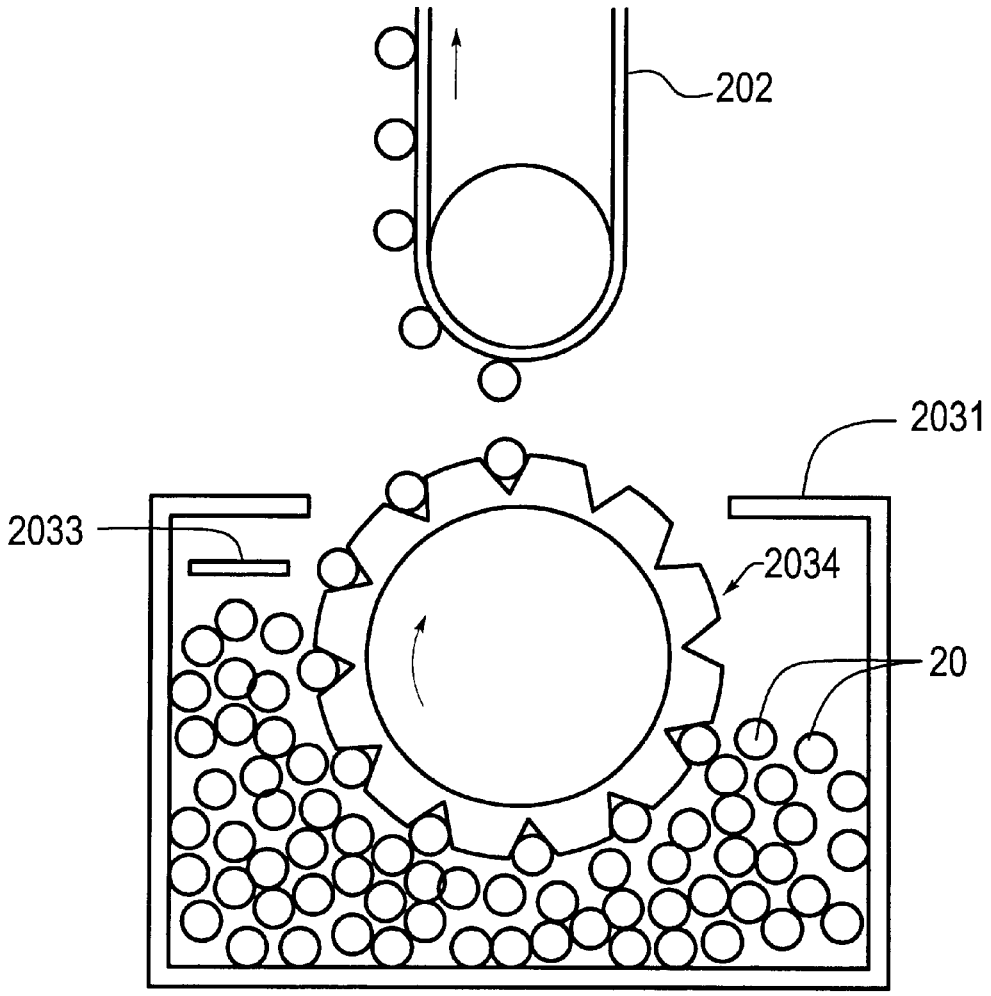
FIG. 28 is a structural view showing a particle conveying apparatus having such structure as to arrange large-diameter particles at intervals on a particle conveying belt.

FIG. 28 is a structural view showing a particle conveying device having such structure as to arrange large-diameter particles 20 on the particle conveying belt 202 at intervals.

This is different from the particle conveying device shown in FIG. 19 in that concave portions of the cylindrical roller on the circumferential portion are formed at intervals. This FIG. 28 shows the concave portions formed at intervals only in the circumferential direction of the cylindrical roller 2034, but the concave portions are formed at intervals also in the direction of the rotating shaft thereof. In each concave portion, the particles 20 enter one piece at a time, and are given to the particle conveying belt 202. Therefore, the particles 20 are to be arranged on the particle conveying belt 202 at intervals.

Figure 29:
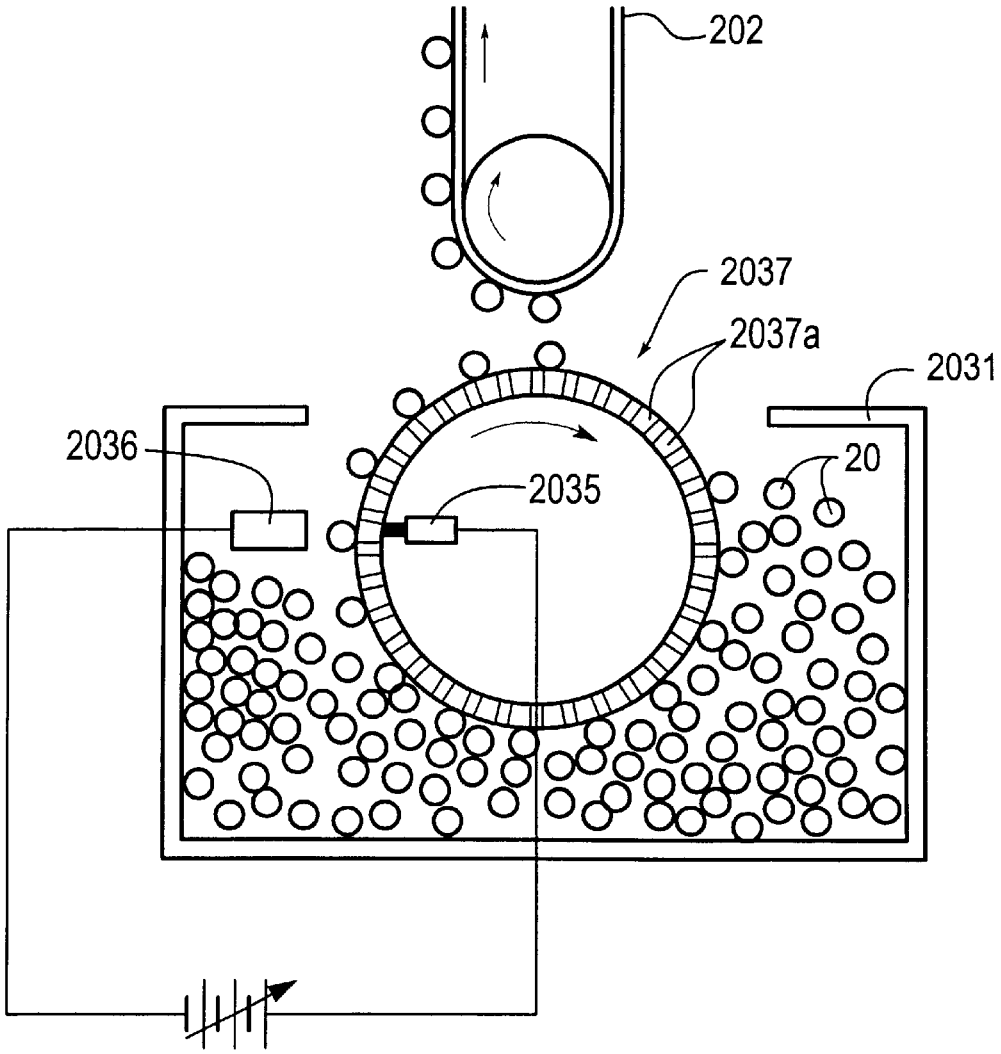
FIG. 29 is a view showing another structural example of a particle conveying apparatus capable of arranging large-diameter particles at intervals on a particle conveying belt.

FIG. 29 is a view showing another structural example of a particle conveying device capable of arranging large-diameter particles 20 on the particle conveying belt 202 at intervals.

In the case of the particle conveying device shown in FIG. 29, there is arranged a cylindrical drum 2037 having a multiplicity of electrodes 2037*a* suitable for the particle diameter of the particles 20 in size, for rotating in the direction indicated by an arrow. Inside the cylindrical drum 2037, a conductive brush 2035 is arranged, and outside the cylindrical drum 2037, a counter electrode 2036 is arranged at a position opposite to the conductive brush 2035. The particles 20 are charged when the particles themselves rub against each other within the particle storage 2031, and when an electric field is imparted between the conductive brush 2035 and the counter electrode 2036, the particles 20 are brought closer to the electrode 2037*a* to adhere to the cylindrical drum 2037. The electric field between the conductive brush 2035 and the counter electrode 2036 is interrupted in accordance with the rotation of the cylindrical drum 2037 whereby the particles 20 can be caused to adhere to the cylindrical drum 2037 at intervals, and the particle arrangement pattern can be transferred onto the particle conveying belt 202 as it is.

In this respect, only one piece of the conductive brush 2035 is shown in FIG. 29, but the conductive brushes 2035 are arranged in the direction of the rotating shaft of the cylindrical drum 2037. The applied voltage to those conductive brushes 2035 is controlled whereby the particle arrangement pattern, in which the particles are arranged at intervals, is implemented also in the direction of the rotating shaft of the cylindrical drum 2037.

Figure 30:
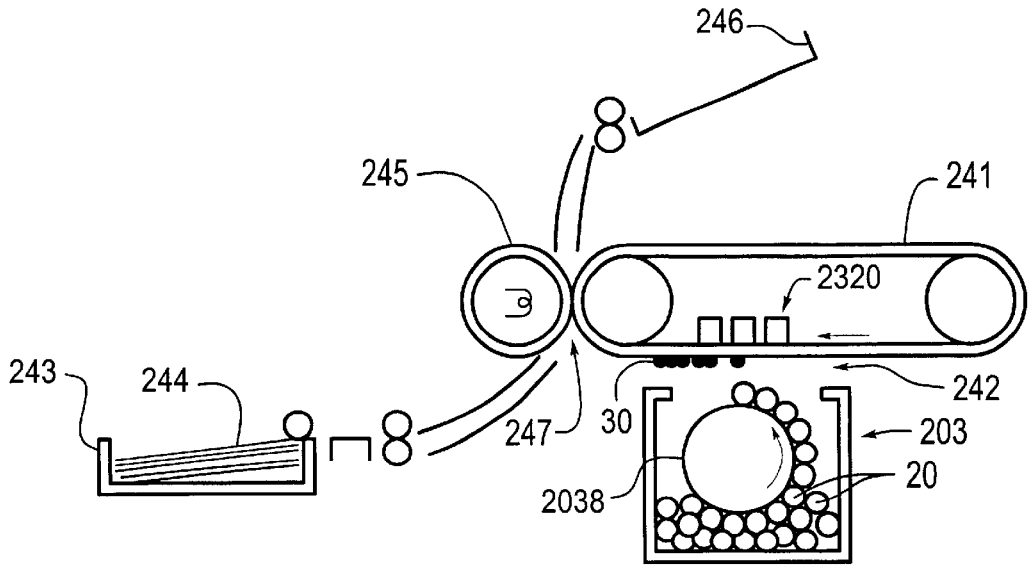
FIG. 30 is a structural view showing another embodiment of image forming apparatus according to the present invention.

FIG. 30 is a structural view showing another embodiment of an image forming apparatus according to the present invention. The image forming apparatus shown in this FIG. 30 is an image forming apparatus for forming a monochromic image, and using limonene liquid in the particle reduction process.

Particles 20 housed within a particle storage 203 are conveyed to a particle moving position 242 opposite to an intermediate recording belt 241 by a particle conveying roller 2038. In conformity with voltage applied, in response to an image signal, between the particle conveying roller 2038 and an image storing device 2320 provided on the back of an intermediate recording belt 241, the particles 20 are moved to the intermediate recording belt 241, and their diameters are reduced by means of limonene liquid supplied by the image storing device 2320 to form an image based on reduced particles on the intermediate recording belt 241. The structure of the image storing device 2320 and the intermediate recording belt 241 will be described later.

The image formed on the intermediate recording belt 241 is conveyed to a transfer position 247. In synchronization therewith, a sheet 244 fed out from a sheet cassette 243 is also conveyed to the transfer position 247, the image is interposed between the intermediate recording belt 241 and the sheet 244, and is heated by a heat roller 245 to transfer the image onto the sheet 244. The sheet 244 onto which the image has been transferred is discharged to a discharge cassette 246 to terminate a series of image forming processes.

Figure 31:
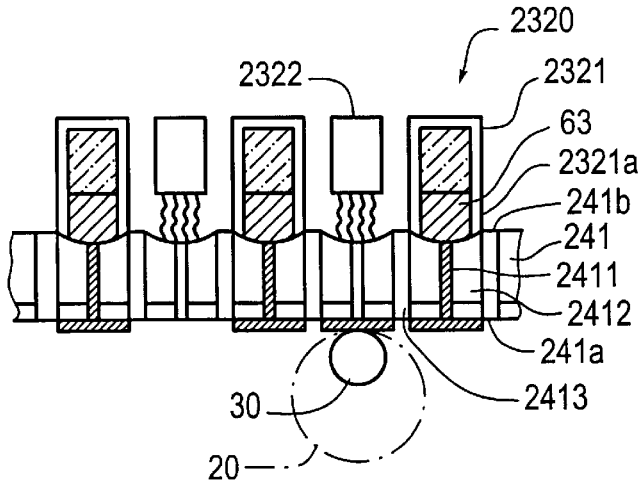
FIG. 31 is a structural view showing an intermediate recording belt and an image storing device in the embodiment shown in FIG. 30.

FIG. 31 is a structural view showing the intermediate recording belt and the image storing device in the embodiment shown in FIG. 30.

The intermediate recording belt 241 is constituted by an assemblage of pixel devices each consisting of a nozzle hole 2411 for causing the limonene liquid 63 to ooze from the back 241*b* to the surface 241*a* of the intermediate recording belt 241 correspondingly to each pixel, and current-carrying portions 2412 around the nozzle hole 2411. Between the pixel devices, there is arranged a dielectric material 2413 for electrically separating the pixel device from each other.

Also, in the image storing device 2320, there are alternately arranged supply nozzles 2321 for supplying limonene liquid 63 to the intermediate recording belt 241, and conductive brushes 2322 for applying voltage for bringing the particles closer to the intermediate recording belt 241. The supply nozzle 2321 slidably contacts the back 241*b* of the intermediate recording belt 241 through packing 2321*a*. In the image storing device 2320, limonene liquid is supplied from the supply nozzle 2321 to a pixel device, in the intermediate recording belt 241, which responds to an image signal, and at a point of time whereat the intermediate recording belt 241 moves a distance of one pixel, voltage is applied to the pixel device to which the limonene liquid has been supplied to cause the particle 20 to move to the pixel device. The particle 20 which has moved onto the pixel device is reduced by means of the limonene liquid on the pixel device to become a reduced particle 30.

Thus, an image based on the reduced particle 30 is formed on the intermediate recording belt 241.

Figure 32:
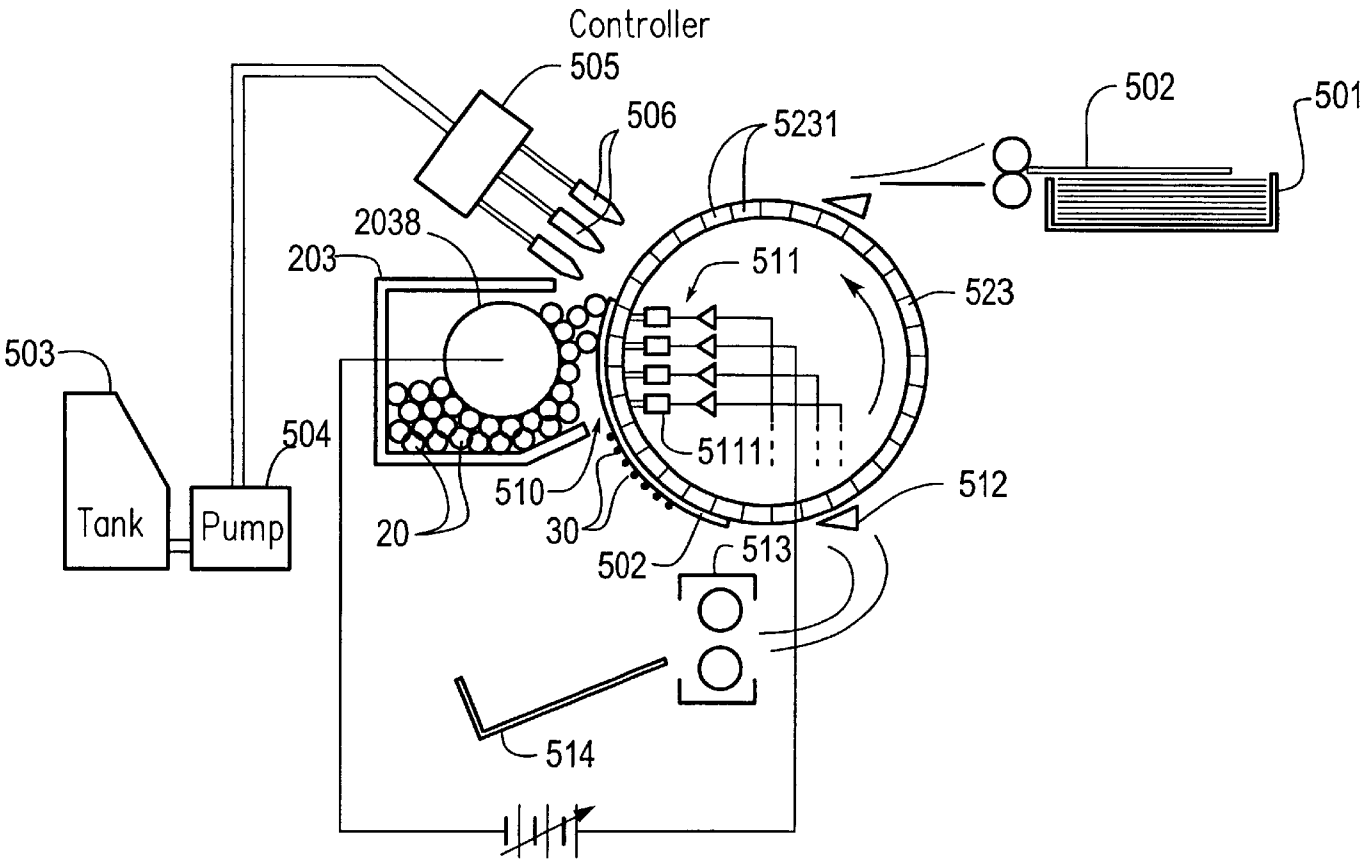
FIG. 32 is a structural view showing further another embodiment of image forming apparatus according to the present invention.
Figure 33:
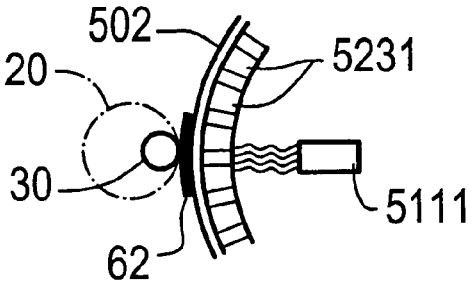
FIG. 33 is a partially enlarged view for the image forming apparatus shown in FIG. 32.
Figure 34C:
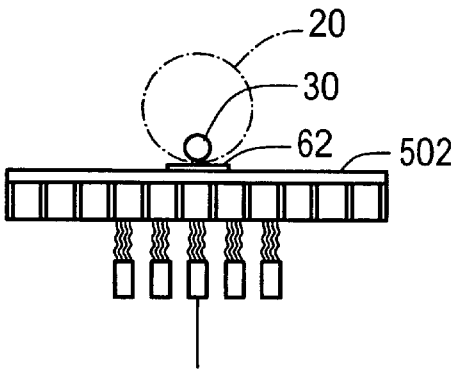
FIGS. 34(A), 34(B) and 34(C) represent a schematic view showing a particle diameter reducing process in the image forming apparatus shown in FIG. 32.

FIG. 32 is a structural view showing further another embodiment of an image forming apparatus according to the present invention; FIG. 33 is a partially enlarged view for the image forming apparatus shown in FIG. 32; and FIG. 34 is a schematic view showing a particle diameter reducing process in the image forming apparatus shown in FIG. 32.

One sheet of sheet 502 is fed out from a sheet cassette 501, and is carried on an electrode drum 523 which rotates in the direction indicated by an arrow. On the electrode drum 523, a multiplicity of electrodes 5231 having sizes corresponding to each pixel are constituted. Onto the sheet 502 carried on the electrode drum 523, the limonene liquid fed out from a tank 503 by a pump 504 is supplied during the conveyance by the electrode drum 523 through nozzles 506 at timing controlled by a liquid discharge controller 505 in response to an image signal (See FIG. 34(A)).

Figure 34B:
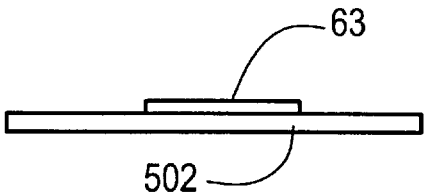
Figure 34A:
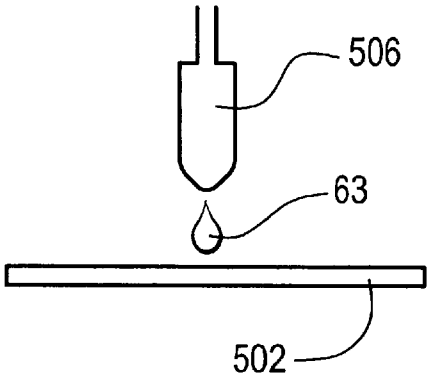

The limonene liquid 63 for one pixel supplied on the sheet 502 spreads over the substantially entire area for one pixel on the sheet 502 (See FIG. 34(B)).

Next, the sheet 502 is carried on the electrode drum 523 to be conveyed to a particle moving position 510 to which the electrode drum 523 and the particle conveying roller 2038 are opposed. Particles 20 stored in a particle storage 203 are conveyed to the particle moving position 510 by the particle conveying roller 2038, and at the same time, voltage is applied to an electrode 5231, of the electrode drum 523, which responds to an image signal, by conductive brushes 5111 constituting the image storing device 511 to bring a particle 20 conveyed by a particle conveying roller 2038 closer to the electrode 5231 to which the voltage has been applied. Since the limonene liquid 63 has been supplied as described above to the pixel portion, on the sheet 502, to which the particle has been brought closer, the particle 20 brought closer there is reduced to become a reduced particle 30 (See FIGS. 33 and 34(C)).

The sheet 502, on whose surface an image based on the reduced particle 30 has been thus formed, is peeled away from the electrode drum 523 by a peeling claw 512, and the image on the sheet 502 is fixed by a fixing device 513 to be discharged to a discharge cassette 514.

As shown in this embodiment, the particle 20 may be directly moved on the sheet for being reduced.

Figure 35:
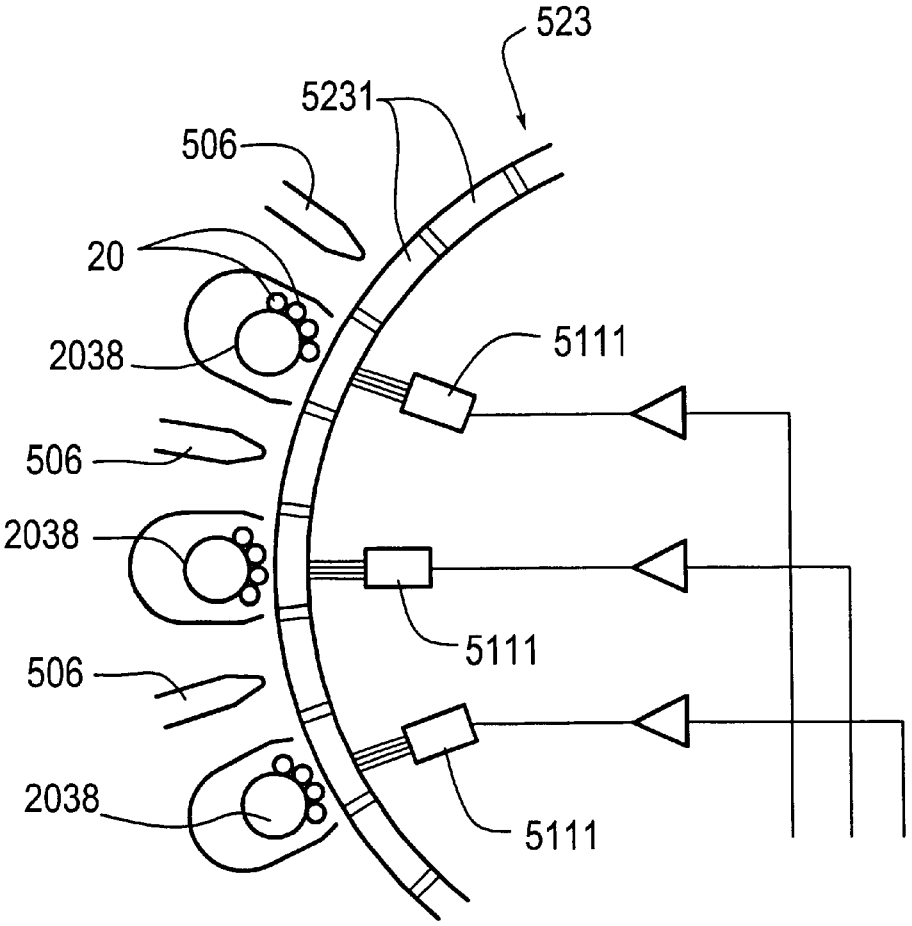
FIG. 35 is a structural view showing characteristic portions in a variation of the embodiment shown in FIG. 32.

FIG. 35 is a structural view showing characteristic portions in a variation of the embodiment shown in FIG. 32.

In an image forming apparatus shown in FIG. 35, there are alternately arranged nozzles 506 for supplying limonene liquid and particle conveying rollers 2038. Limonene liquid supplying parts and particle moving parts may be arranged at positions separate from each other as shown in FIG. 32, and may be alternately arranged as shown in FIG. 35.

According to each of embodiments described above, instead of such particle pixel position control as a particle assemblage as has been performed in a conventional electrophotography apparatus, it becomes possible to cause individual particles to correctly move, fly, transfer and adhere at a desired position on an image carrier such as a sheet and an intermediate member. Also, by the adoption of a reduction process of reducing the particle diameter from a large diameter to a small diameter, it is possible to reduce the required electric field when, for example, an electrostatic force is used as a driving force more than a figure by enabling a driving force for moving the particle to be increased to the square to cube of the diameter as compared with the conventional case without impairing the adhesion precision of the individual particles to the pixel positions. This means that reliability that the driving force can be stably used is also obtained.

Therefore, the present invention can be applied to monochromic and color copying machines, printers and facsimile apparatuses as recording technique capable of high-precision pixel alignment, and also to printers for mass printing (CRD). On the other hand, it has also an ability as a color proofer in which great importance is attached to high image quality.

Effect of the Invention

As described above, the present invention exhibits the following effects:

(1) High-definition image quality can be obtained because a capsule particle having a powder particle (coloring material) or colored liquid coloring material covered with an outer skin can be caused to move, fly, transfer, and adhere at a desired pixel position on a image recording medium.

(2) Since no photoreceptor is used unlike a conventional electrophotographic process, and yet a force capable of driving a particle can be taken as great as square to cube, an electric field or a magnetic field required for that portion can be exceedingly suppressed. Therefore, a stable particle driving environment (process conditions) can be obtained, and the reliability is greatly improved. Also, the apparatus can be small-sized and the costs can be reduced.

(3) In the particle conveying device, image recording media and the like, it does not become necessary to move or rotate them with a high degree of accuracy. Since general precision may be applied to both component precision and assembly precision, they are suitable for mass production, and it becomes possible to reduce the costs.

What is claimed is:

1. An image forming apparatus, comprising:

a particle conveying member that carries a particle, whose diameter reduces when it is subjected to a predetermined stimulus, on the surface thereof, to convey the particle to a predetermined particle moving position;

a particle moving part that moves the particle carried and conveyed by said particle conveying member to a position in conformity with image information on a predetermined image carrier which has moved to a position opposite to the surface of said particle conveying member, at said particle moving position; and a particle diameter reducing part that reduces the diameter of said particle by imparting a predetermined stimulus to the particle moved onto said image carrier.

2. The image forming apparatus according to claim 1, wherein said image carrier is an image recording medium on which an image is finally recorded.

3. The image forming apparatus according to claim 1, wherein said image carrier is an intermediate recording medium on which an image is temporarily recorded, and is provided with a transfer part that transfers an image recorded on said intermediate recording medium, which image consists of an assemblage of particles whose diameters have been reduced, onto an image recording medium on which an image is finally recorded, directly from said intermediate recording medium, or through an intermediate transfer medium other than said intermediate recording medium.

4. The image forming apparatus according to claim 1, wherein said particle is a particle whose diameter is reduced by heat being imparted thereto, and said particle diameter reducing part is a part that imparts heat to a particle which has moved onto said image carrier.

5. The image forming apparatus according to claim 1, wherein said particle is a particle whose diameter is reduced by limonene liquid being imparted thereto, and said particle diameter reducing part is a part that imparts limonene liquid to a particle which has moved onto said image carrier.

6. The image forming apparatus according to claim 1, further comprising a particle supplying part that forms a particle layer having the thickness of one piece of said particle on the surface of said particle conveying member.

7. The image forming apparatus according to claim 1, further comprising a particle supplying part that arranges said particles at intervals between the particles on the surface of said particle conveying member.

8. The image forming apparatus according to claim 1, wherein said particle moving part has a plurality of elements, arranged on a back side of the front surface of the particle moving part, on which the particles moved are received in said image carrier at said particle moving position, each of which elements causes one particle to move from said particle conveying member to said image carrier at one time.

9. The image forming apparatus according to claim 8, wherein each of said elements has a particle diameter reducing function that constitutes said particle diameter reducing part.

10. The image forming apparatus according to claim 8, wherein each of said elements is applied with voltage, and causes particles to move by an electric field generated by said voltage being applied, and said particle moving part applies voltage to an element in conformity with image information and grounds an element adjacent to said element.

11. The image forming apparatus according to claim 1, wherein by causing one group consisting of said particle conveying member, said particle moving part and said particle diameter reducing part to correspond to each of particles containing coloring material different from one another, a plurality of groups in total are provided to thereby form an image consisting of a plurality of colors on an image recording medium on which an image is finally recorded.

* * * * *